US006260962B1

(12) United States Patent
Yano et al.

(10) Patent No.: US 6,260,962 B1
(45) Date of Patent: Jul. 17, 2001

(54) LIQUID JETTING DEVICE HAVING A MECHANISM FOR INTRODUCING A BUBBLE INTO A LIQUID CHAMBER AND RECORDING APPARATUS USING THE DEVICE

(75) Inventors: Kentaro Yano, Yokohama; Masami Ikeda, Tokyo; Hiromitsu Hirabayashi, Yokohama; Shigeaki Tanaka, Kawasaki; Miyuki Matsubara, Tokyo; Naoji Otsuka, Kawasaki; Hitoshi Sugimoto; Kiichiro Takahashi, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/280,565

(22) Filed: Jul. 25, 1994

Related U.S. Application Data

(63) Continuation of application No. 07/820,940, filed on Jan. 15, 1992, now abandoned.

(30) Foreign Application Priority Data

Jan. 19, 1991 (JP) ..... 3-004739
Jan. 19, 1991 (JP) ..... 3-004740
Jan. 10, 1992 (JP) ..... 4-003227

(51) Int. Cl.[7] ..... B41J 2/17; B41J 2/05
(52) U.S. Cl. ..... 347/94; 347/56
(58) Field of Search ..... 347/13, 22, 30, 347/56, 60, 67, 87, 92, 94, 44, 47, 48

(56) References Cited

U.S. PATENT DOCUMENTS 4,158,847 * 6/1979 Heinzl et al. ..... 347/40
4,320,407 * 3/1982 Goldis et al. ..... 347/92
4,463,359 * 7/1984 Ayata et al. ..... 347/56
4,466,005 * 8/1984 Yoshimura ..... 347/92 X
4,550,326 * 10/1985 Allen et al. ..... 347/44
4,646,110 2/1987 Ikeda et al. ..... 347/15
4,719,472 * 1/1988 Arakawa ..... 347/67
4,723,129 * 2/1988 Endo et al. ..... 347/56
4,897,674 * 1/1990 Hirasawa ..... 347/94
4,982,199 * 1/1991 Dunn ..... 347/15
4,994,824 2/1991 Winslow ..... 347/87
5,021,809 * 6/1991 Abe et al. ..... 347/94
5,053,787 * 10/1991 Terasawa et al. ..... 347/22
5,109,233 * 4/1992 Nishikawa ..... 347/35 X
5,109,234 * 4/1992 Otis, Jr. et al. ..... 347/60
5,142,308 * 8/1992 Hasegawa et al. ..... 347/62
5,172,134 * 12/1992 Kishida et al. ..... 347/60 X
5,262,802 * 11/1993 Karita et al. ..... 347/87

FOREIGN PATENT DOCUMENTS 0353925 2/1990 (EP) .
0451827 10/1991 (EP) .
2184066 6/1987 (GB) .
55-128465 10/1980 (JP) .
59-98859 6/1984 (JP) .
61-035254 2/1986 (JP) .
0169657 * 7/1987 (JP) .
62-184857 8/1987 (JP) .
62-240558 10/1987 (JP) .
1-178451 * 7/1989 (JP) ..... 347/47
0110172 * 5/1991 (JP) .

* cited by examiner

*Primary Examiner*—David F. Yockey
(74) *Attorney, Agent, or Firm*—Fitzpatrick, Cella, Harper & Scinto

(57) ABSTRACT

A liquid jetting device includes a plurality of liquid passages each having a liquid ejecting element and communicating with an ejection hole, a common liquid chamber communicating with each of the plurality of liquid passages and an air bubble introducer for making a non-disappearable air bubble formed by thermal energy exist in the common liquid chamber before a start of liquid ejection. The liquid is allowed to be ejected in the presence of the air bubble. The non-disappearable air bubble functions as a buffer to absorb pressure during discharge to restrict flow of the ink in the direction opposite to the discharge port.

28 Claims, 15 Drawing Sheets

LIQUID JETTING DEVICE HAVING A MECHANISM FOR INTRODUCING A BUBBLE INTO A LIQUID CHAMBER AND RECORDING APPARATUS USING THE DEVICE

This application is a continuation of application Ser. No. 07/820,940 filed Jan. 15, 1992, now abandoned.

BACKGROUND OF THE INVENTION

1. Field of the Invention

This invention relates to a device for jetting a liquid with stability from an initial jetting stage and an ink-jet recording apparatus. More particularly, it enables prevention of second-operation liquid jetting failure by introducing a bubble into a liquid chamber. The present invention can be applied to an apparatus and a method for printing out information input into an office automation apparatus such as a personal computer or a word processor.

2. Related Background Art

In ink-jet recording based on jetting liquid droplets, there is a problem that after a long resting period or after turning on the main switch, a first ejection recording operation can be suitably performed but the performance of a second ejection recording is unstable.

It is known that if an electromechanical conversion member is used as an ejection element, such a problem is caused by a phenomenon in which high-frequency vibration of ink due to mechanical vibration moves an ink meniscus to and fro, or by the influence of pressure waves reflected by walls traveling toward the ejection holes. To solve this problem, various means have been invented which relate to improvements in an electrical signal applied to the electrothermal conversion member. However, this problem entails further complicated phenomena according to changes in ink characteristics and changes in environmental factors and, therefore, no method is known which solves this problem with reliability.

If an electrothermal conversion member is used as an ejection element, the change in recording performance is small while the corresponding change in the case of a mechanical conversion member is large. However, a method is known in which the influence of interference between an electrothermal conversion member and an adjacent ejection section is recognized to set the liquid passage length and the position of a liquid chamber wall in accordance with predetermined conditions. Specifically, Japanese Patent Laid-Open Publication No.55-128465 discloses an arrangement in which a small hole communicating with the atmosphere is formed in an ink passage wall on the liquid chamber side of the electrothermal conversion element to reduce the magnitude of a pressure wave. This arrangement is effective in practice but also entails the problem of ink evaporation through the small hole or the problem of ink setting and attaching in the vicinity of the small hole if the recording head is left unused for a long time, and there is also a possibility of operation failure when recording is started after the non-use period.

On the other hand, it is well known that a suitable initial ejection condition can be achieved by performing a suction recovery operation. U.K. Unexamined Patent Publication No.2184066 discloses an arrangement in which suction recovery is effected after introducing air into a common liquid chamber communicating with a plurality of ejection holes as well as into these ejection holes. Recovery in the common liquid chamber can thereby be effected at one time, which is advantageous.

In the field of conventional recording heads, however, no suitable function has been achieved which effectively prevents occurrence of recording failures immediately after the start of recording after a long unused period without being seriously influenced by environmental changes or various changes in conditions. With respect to other types of liquid jetting, there is no satisfactory method or apparatus for solving the problem.

In many of the conventional ink jet recording apparatuses, ink is continuously effected through one ejection hole depending upon recording data on an image or a character to be recorded. If such continuous ejection is effected after an unused period or immediately after the main switch has been turned on, a dot formed on a recording sheet by a second ejection operation for this continuous ejection is formed as a defective dot, usually resulting in a deterioration in recording quality. The cause of such failure to form a suitable dot by the second ejection operation has been studied to develop the following theory.

The force with which the ink flows towards the discharge end is given as follows:

<capillary force>+<inertia force><bubbling energy at liquid chamber side><tank vacuum> (1)

The refill time is determined in accordance with the force which is given by the formula (1) shown above.

It is to be noted, however, that the condition of the formula (1) above is not met when the discharge is performed for the first time. This is because the bubble is generated while the ink is in a stationary state. Namely, when the ink discharge is performed for the first time, the bubble is generated under the condition where there is no flow of ink towards the discharge end. Therefore, the force of flow of ink for refilling conducted between successive first and second discharges is given as follows:

<capillary force>−<bubbling energy at liquid chamber side>−<tank vacuum> (2)

As will be seen from the formulae (1) and (2) above, the ink supply characteristic for supplying ink from the common liquid chamber 1 to the nozzle, i.e., the force for forcing the ink towards the discharge end, is such that a longer refilling time is required in case of the formula (2), because the force for forcing the ink towards the discharge end is smaller in the case of the formula (2) than in the case of the formula (1). That is, a longer refilling time is required for the refilling after the first discharge than for other refilling operations. Usually, the time interval between the first and second discharges is not set specifically longer than other intervals. The ink droplet formation failure in the second discharge is considered to be attributable to this fact.

This causes a practical problem such that, when a vertical line is to be formed by two dots as shown in FIG. 8A, a line image in the form of an aggregation of tiny droplets is formed as shown in FIG. 8B, due to failure in the formation of the ink droplet for the second dot.

Anyway, if the first driving energy is applied to the ink having an inertia, an excessively large pressure is generated in the common liquid chamber, when the ink is discharged by energy of bubble produced by the electrothermal conversion element. Consequently, the ink is compressed by this pressure so as to have a large inertia. Meanwhile, the meniscus continues to move from the discharge opening towards the electrothermal conversion element until the ink is supplied. This tendency is maintained until the bubble is generated. In this state, the supply of the ink into the common liquid chamber tends to be delayed as compared with the case of ordinary recording operation, due to the large inertia applied to the ink in the common liquid chamber. In addition, the recording system relying on the ink discharge by means of the bubble exhibits a high speed of response to the recording signal. Consequently,the second driving signal is undesirably input to the electrothermal conversion element, so that the meniscus tends to further move towards the common liquid chamber. This also is attributable to the delay of propagation of the pressure generated by the bubble towards the common liquid chamber, due to the fact that the impedance of the flow passage between the bubble and the common liquid chamber is smaller than that between the bubble and the discharge opening. Thus, the filling of the common liquid chamber with ink is delayed and, in addition, retraction of the meniscus towards the common liquid chamber is increased. The discharge failure in the second discharge is attributable to these facts.

The bubble generated for the second discharge is more liable to move towards the common liquid chamber than in other discharges, partly because of the retraction of the meniscus. The state of extinction of the bubble also is different from that in other discharges.

Thus, it has proved that the novel technical subject described above, peculiar to the system which relies upon thermal energy for generating bubble, is entirely different from the problems which have been conventionally recognized in regard to the phenomenon or behavior of conventional electrothermal conversion elements.

SUMMARY OF THE INVENTION

A main object of the present invention is to provide a liquid jetting device which is free from the above-described specific drawbacks of liquid jetting devices using an electrothermal conversion member, and which, preferably, can effectively solve the above-described problems in the case of using other types of ejection elements.

Another object of the present invention is to provide a liquid jetting device capable of suitably jetting a liquid droplet using an electrothermal conversion member or capable of suitably forming liquid droplets without being influenced by various environmental changes or changes in ink (liquid) characteristics.

Still another object of the present invention is to provide a liquid jetting recording head having a novel reliable air bubble introducing means for introducing air bubbles which positively act in an air-existing region in a common liquid chamber and a recording apparatus using this recording head.

A further object of the present invention is to provide an ink-jet recording apparatus and a recording head capable of limiting retardation refilling immediately after the first ejection operation in a continuous ejection process.

To achieve these objects, according to one aspect of the present invention, there is provided a recording head for ejecting ink, comprising an ejection hole through which ink is ejected, an ejection energy application section communicating with the ejection hole and for applying ejection energy to ink to eject ink, an ink reservoir section communicating with the ejection energy application section and containing ink to be supplied to the application section, and air bubble formation means for making an air bubble exist in the ink reservoir section before recording, the air bubble being formed by heating. Preferably, an electrothermal conversion member for generating thermal energy as ejection energy is provided in the ejection energy application section, film boiling is caused by the thermal energy, and ink is ejected based on generation of a bubble caused by the film boiling. According to this arrangement, a suitable air bubble which does not badly influence ejection can be formed by the bubble formation means, e.g., a warming sub heater, for heating ink in the ink reservoir section, e.g., a common liquid chamber. The air bubble thereby formed can act as a buffer and can absorb foaming energy (pressure wave) acting to the common liquid chamber during ejection foaming by expanding/contracting, thereby limiting ink flows toward a position opposite to the ejection hole. That is, it is possible to rapidly refill ink after ejection.

Air-buffer bubble formation in accordance with the present invention can be effected by, for example, a heating means for previously generating bubbles of air dissolved in ink to effectively utilize the bubbles for recording so that ink characteristics are stabilized, or any other means such as an external heating means, an internal heating means or heating means formed on a substrate integrally with an ejection heater, so long as such air bubbles can be formed in the ink reservoir section including an ink containing section for supplying ink to the common liquid chamber or the liquid passage.

In practice, it is preferable to use film boiling as an ejection means and to use nucleate boiling or other positive bubble formation means based on heating at a lower temperature as a means for forming the above-described air bubble. According to the present invention, it is, in fact, important that a bubble buffer exists at an initial stage of a recording process.

According to another aspect of the present invention, there is provided an ink-jet recording apparatus for effecting recording by ejecting ink, comprising a recording head having an ejection hole through which ink is ejected, a liquid passage communicating with the ejection hole and having an electrothermal conversion member for generating thermal energy to form an air bubble for ejecting ink, and a liquid chamber communicating with the liquid passage and containing ink to be supplied to the liquid passage when ink is ejected, driving means for driving the electrothermal conversion member to generate thermal energy; and control means for controlling the driving means to make the electrothermal conversion means generate a bubble which does not act to eject ink. Preferably, the liquid chamber has a sectional area greater than a transverse sectional area of the liquid passage, and has a slant wall surface. According to this arrangement, the electrothermal conversion member in the liquid chamber can be driven to form comparatively fine air bubbles not acting to eject in. These bubbles move to the liquid chamber communicating with the liquid passage to be collected as one bubble at a predetermined position in the liquid chamber. Consequently, this bubble functions as a buffer and absorbs foaming energy (pressure wave) acting to the common liquid chamber during ejection foaming by being deformed, thereby limiting ink flows toward a position opposite to the ejection hole. That is, it is possible to rapidly refill ink after ejection.

According to still another aspect of the present invention, there is provided an ink jet recording apparatus for effecting recording by ejecting ink onto a recording medium, comprising a recording head having an ejection hole through which ink is ejected, a liquid passage communicating with the ejection hole and having a thermal energy generation section for generating thermal energy to form an air bubble for ejecting ink, and a liquid chamber communicating with the liquid passage and containing ink to be supplied to the liquid passage when ink is ejected, driving means for generating thermal energy in the thermal energy generation section, and control means for controlling the driving means to generate in the thermal energy generation section fine air bubbles which do not act to eject ink, and for thereafter growing air bubbles from nuclei formed of the fine air bubbles.

According to a further aspect of the present invention, there is provided an ink jet recording apparatus for effecting recording by ejecting ink onto a recording medium, comprising a recording head having an ejection hole through which ink is ejected, a liquid passage communicating with the ejection hole and having a thermal energy generation section for generating thermal energy to form an air bubble for ejecting ink, and a liquid chamber communicating with the liquid passage and containing ink to be supplied to the liquid passage when ink is ejected, driving means for generating thermal energy in the thermal energy generation section, control means for controlling the driving means to generate in the thermal energy generation section air bubbles which do not act to eject ink, and ejection recovery means for discharging ink through the ejection hole to suitably maintain the state of ink ejection from the ejection hole, the ejection recovery means discharging ink at a smaller discharge rate or by smaller discharge power in comparison with the discharging for suitably maintaining the state of ink ejection, when bubbles not acting to eject ink are formed by the control means.

According to still a further object of the present invention, there is provided an ink jet recording apparatus for effecting recording by ejecting ink onto a recording medium, the apparatus comprising a recording head having an ejection hole through which ink is ejected, a first liquid passage communicating with the ejection hole and having a thermal energy generation section for generating thermal energy to form an air bubble for ejecting ink, a second liquid passage provided at least one side of the first liquid passage and having a thermal energy generation section for generating thermal energy, and a liquid chamber communicating with the first and second liquid passages and containing ink to be supplied to the first and second liquid passages when ink is ejected, driving means for generating thermal energy in the thermal energy generation sections of the first and second liquid passages, and control means for controlling the driving means to generate air bubbles which do not act to eject ink in the thermal energy generation section of the second liquid passage.

According to each arrangement described above, a comparatively large air bubble is formed from a nucleus formed of a fine bubble generated in the liquid passage, so that a buffering bubble can be effectively formed in the liquid chamber. This buffering bubble can absorb foaming energy (pressure wave) acting to the common liquid chamber during ejection foaming to control an ink flow toward a position opposite to the ejection hole. That is, it is possible to rapidly refill ink after ejection.

After the buffering bubble has been formed in the liquid chamber, a suction operation for ejection recovery is performed by a smaller suction force or at a smaller rate in comparison with ordinary recovery, thereby preventing the problem of the formed buffering bubble being discharged by the ejection recovery operation.

Further, a buffering bubble can be formed in a dummy-nozzle liquid passage provided at an end of a row of ejection holes used for recording.

DESCRIPTION OF THE PREFERRED EMBODIMENTS

Figure 1:
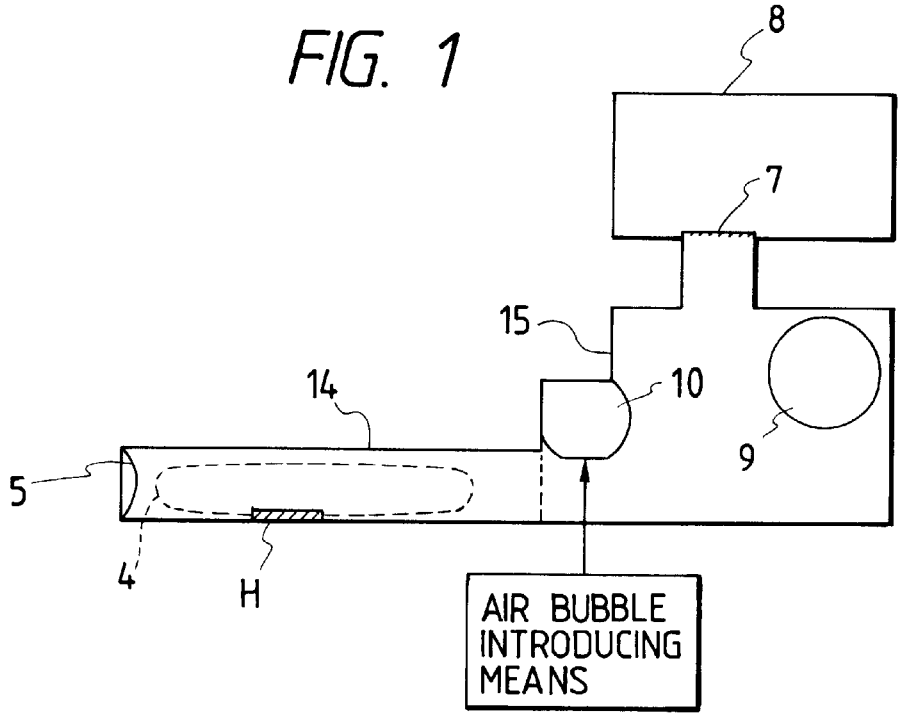
FIG. 1 illustrates the structure of an ink jet recording head according to the present invention.

FIG. 1 is a schematic diagram of a basic concept of the present invention. In FIG. 1 are illustrated two air bubbles which exist at certain distances from a filter 7 in a common liquid chamber 15 by a means for introducing air bubbles into the common liquid chamber. A reference numeral denotes a meniscus in a liquid passage 14, a reference numeral 4 denotes a bubble which is formed by film boiling caused by an electrothermal conversion element H to eject ink, and a reference numeral 8 denotes an ink supply means. In this apparatus, ejection holes are communicated with the atmosphere while the common liquid chamber and the liquid passages do not directly communicate with the atmosphere. FIG. 1 shows a state where the apparatus starts recording or jetting after a state of being left unused.

The air bubble introducing means introduces bubble 10 or floating bubble 9 into the common liquid chamber before initial ejection. Electrothermal conversion element 4 is driven by an initial ejection signal to form bubble 4. A substantially large instantaneous pressure thereby caused reaches the common liquid chamber, acts to change the volume of bubbles 10 and 9 and, in consequence, attenuates in a short time. In other words, no pressure concentration occurs which forcibly moves ink in the common liquid chamber toward the filter 7. Ink can be suitably supplied from the supply means 8 since the amount of ink in the common liquid chamber having a large inertial force is reduced. Also, bubbles 10 and 9 may be deformed at this time so that ink in the common liquid chamber is partially moved to restore its initial operation state, thereby reducing the inertia thereof. This phenomenon is also advantageous in terms of the effect of the present invention.

It will be understood that the above-described cause can be eliminated by forming bubbles at any position in the common liquid chamber except for a position closer to the filter by using such an air bubble introducing means.

FIGS. 3 to 7 show devices or units suitably used to form an embodiment of the present invention, i.e., a recording head unit IJU, an ink tank IT, a recording cartridge IJC, an ink-jet recording apparatus body IJRA, and a carriage HC, and show the relationships between these components. The constructions of these components will be described below with reference to FIGS. 3 to 7.

Figure 3:
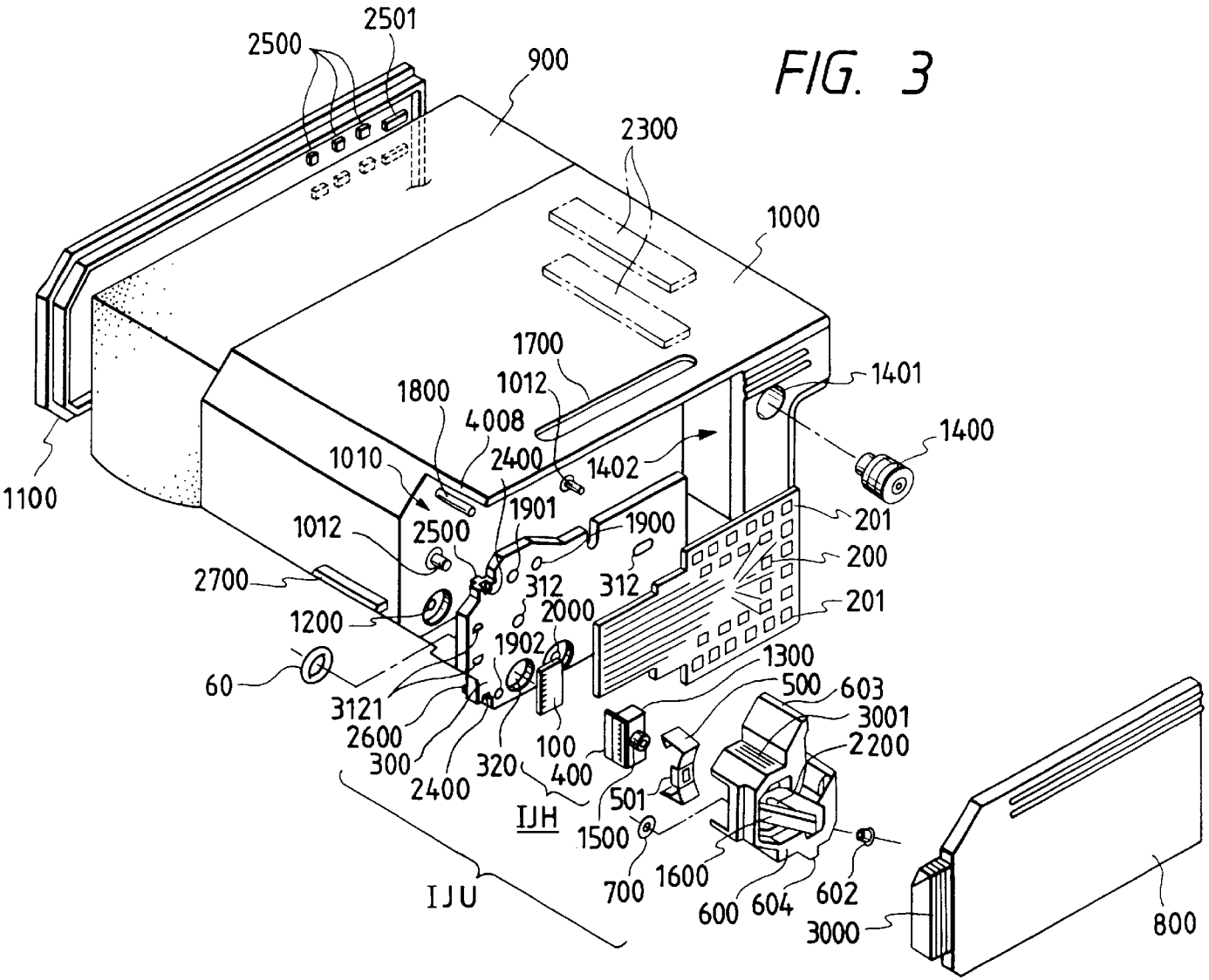
FIG. 3 is an exploded perspective view of a recording head cartridge in which an ink tank is formed integrally with the recording head, showing an embodiment of the present invention.

FIG. 3 is an exploded perspective view of an example of a head cartridge.

The recording head unit IJU shown in FIG. 3 is a bubble jet type unit which causes film boiling in ink to eject ink by producing thermal energy in accordance with an electrical signal. A heater board 100 has a plurality of electrothermal conversion elements (ejection heaters) arranged in a row on a silicon substrate to produce thermal energy for this ink ejection, and electric conductors formed of Al or the like and used to supply electric power. These elements and conductors are formed by a film forming technique. A wiring board 200 has electric conductors (connected by wire bonding, for example) corresponding to those of the heater board 100, and pads 201 disposed at the ends of these conductors to receive electrical signals from the apparatus body. A ceiling plate 1300 has partition wall portions for forming ink passages corresponding to a plurality of ejection holes and a common liquid chamber. The ceiling plate 1300 is integrally provided with an ink receiving port 1500 through which ink supplied from an ink tank is introduced into the common liquid chamber, and an orifice plate 400 having a plurality of ejection holes. The partition walls and other members on the ceiling plate 1300 are formed integrally with the ceiling plate 1300. The material of these integrally formed members is, preferably, polysulphone. However, it may be selected from any other molding resin.

A support 300 member is a flat surface for supporting a reverse side of the wiring board 200, and is formed of, e.g., a metal. The support 300 serves as a structural member of the recording head unit. An M-shaped retention spring 500 presses a portion of the ceiling plate 1300 corresponding to the common liquid chamber through its portion corresponding to the center of the shape of M. The retention spring 500 also has a front lug 501 which contacts a portion of the ceiling plate 1300 corresponding to the liquid passages in a line contact manner to press this ceiling plate portion. Leg portions of the retention spring 500 pass through holes 3121 of the support 300 to engage with reverse surface portions of the support 300 so that the heater board 100 and the ceiling plate 1300 are pinched between the support 300 and the retention spring 500. That is, the heater board 100 and the ceiling plate 1300 are fixed on the support 300 by being pressed thereon by the urging force of the retention spring 500 and the front lug 501 of the same. The support 300 has two holes 312 and two holes 1900 and 2000 for engagement with two positioning projections 1012 and two positioning/fusion-fastening projections 1800 and 1801 provided on the ink tank, and projections 2500 and 2600 which are provided on its reverse side to position the head cartridge with respect to the carriage on the apparatus body. The support 300 also has a hole 320 through which an ink supply pipe 2200 (described later) for supplying ink from the ink tank can pass. The wiring board 200 is attached to the support by an adhesive or the like.

Figure 4:
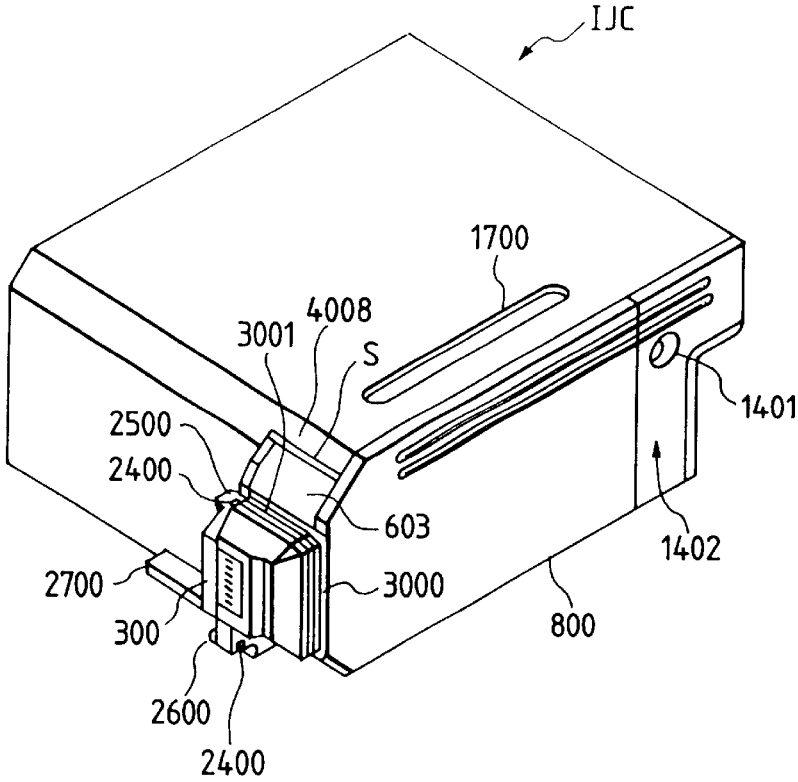
FIG. 4 is a perspective view of the recording head cartridge shown in FIG. 3.

Recesses 2400 are formed in the support 300 in the vicinity of the positioning projections 2500 and 2600. These recesses coincide with points on productions of parallel grooves 3000 and 3001 formed in three peripheral sides of the recording head unit IJU of the head cartridge when the head cartridge is assembled (as shown in FIG. 4), so that unnecessary materials such as dust and ink are prevented from reaching the projections 2500 and 2600. A cover member 800 in which the parallel grooves are formed forms an outer wall of the head cartridge and forms a section in which the recording head unit IJU is accommodated. An ink supply passage member 600 in which parallel grooves 3001 are formed has an ink conduit 1600 which communicates with the above-mentioned ink supply pipe 2200 when connected to this pipe. The ink conduit 1600 is formed as a cantilever fixed at the position where it is connected to the supply pipe 2200. The ink supply passage member 600 also has a sealing pin 602 for ensuring a capillarity between an ink conduit fixed portion and the ink supply pipe 2200. A packing 601 is provided for connection sealing between the ink tank and the supply pipe 2200. A filter 700 is disposed at a tank-side end of the supply pipe 2200. The ink supply passage member 600 can be manufactured at a low cost and can be formed with improved positional accuracy, because it is formed by molding. Moreover, by designing the conduit 1600 in the form of a cantilever, it is possible to stabilize the state of contact between the conduit 1600 and the ink receiving port 1500 of the ceiling plate 1300. In this embodiment, a sealing adhesive is poured from the ink supply passage member side when these portions are maintained in contact with each other under pressure.

The ink supply passage member 600 can easily be fixed on the support 300 in such a manner that pins provided on a reverse side of the ink supply passage member 600 so as to face the holes 1901 and 1902 of the support member 300 are passed through these holes, and portions of these pins projecting on the reverse side of the support 300 are fuse-fastened by heat. Each of small projections fuse-fastened on the reverse side is accommodated in a recess (not shown) in a wall of the ink tank on the recording head unit IJU attachment side and, therefore, a unit IJU positioning surface can abut against the ink tank surface precisely.

The ink tank is formed by a cartridge body 1000, an ink absorber 900 and a cover 1100 for closing one side of the ink tank opposite to the above-mentioned unit IJU attachment side after inserting the ink absorber 900 through this side. The absorber 900 is disposed in the cartridge body 1000. A supply port 1200 is provided through which ink is supplied to the unit IJU formed of the above-described members 100 to 600. Ink is also injected into the ink tank through the supply port 1200 before the step of fitting the unit IJU to a portion 1010 of the cartridge body 1000. The absorber 900 is thereby impregnated with ink. In the head cartridge in accordance with this embodiment, ink can be injected into the ink tank through an atmospheric air communication port 1401 or the supply port 1200. In this arrangement, however, an air-existing region which is formed by ribs 2300 formed on an inside surface of the body 1000 and ribs 2500 and 2501 formed on an inside surface of the cover 1100 is provided in a place such as to be continuous with the atmospheric air communication port 1401 and to be located at a corner remotest from the ink supply port 1200, so that a suitable effect of supplying ink from the ink absorber is maintained. It is therefore important to inject ink into the absorber through the supply port 1200 for relatively effective and uniform ink injection. This method is very effective in practice. Four ribs 2300 (only upper two of which are illustrated in FIG. 3) parallel to the direction of carriage movement are provided on a rear portion of the ink cartridge body 1000 to prevent the absorber from closely contacting the surface of the body 1000. The partial ribs 2501 are formed on the inside surface of the cover 1100 in positions at which productions of longitudinal axes of the ribs 2300 meet the cover 1100, and the ribs 2500 are formed at the same heights as the ribs 2501. The ribs 2500 and 2501 are separately formed unlike the ribs 2300 to increase the air-existing space. The ribs 2500 and 2501 are distributed to inside surface regions of the cover 1100 the area of which is not greater than the total area of the inside surface of the cover 1100. By the provision of these ribs, ink in an ink tank region at the corner of the ink tank remotest from the tank supply port 1200 can be led to the supply port 1200 with improved reliability and stability by capillary action. The atmospheric air communication port 1401 is formed in a cover member for communication between the interior of the ink tank and the atmosphere. A water-repellent member 1400 is disposed in the atmospheric air communication port 1401 to prevent ink from leaking out through the atmospheric air communication port 1401.

The ink accommodation space of the ink tank is rectangular. If one side of this space perpendicular to the direction of carriage movement corresponds to the major side of the rectangle viewed in plan as in the case of this embodiment, the above-described rib arrangement is specifically effective. However, if the major side of the rectangle is parallel to the direction of carriage movement, or if the ink accommodation space is cubical, ribs may be continuously formed through the overall length of the inside surface of the cover 1100 to stabilize the supply of ink from the ink absorber 900.

Figure 5:
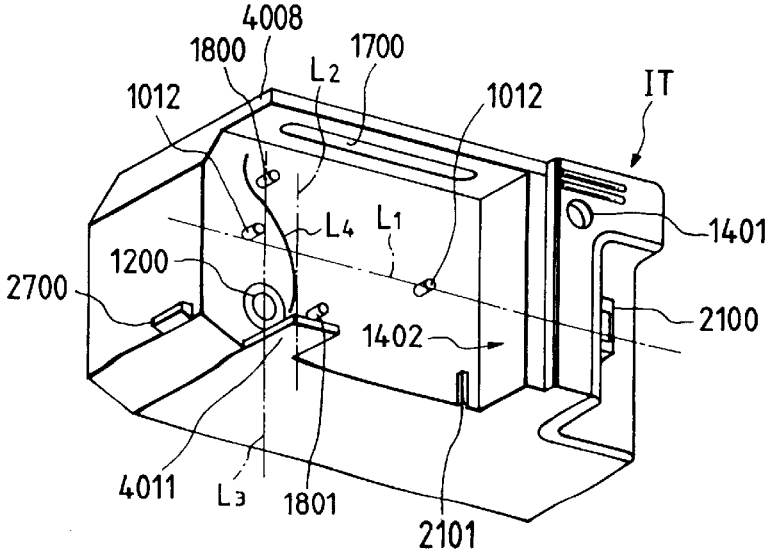
FIG. 5 is a perspective view of an ink tank unit shown in FIG. 3.

FIG. 5 shows the construction on the unit IJU attachment side of the ink tank IT. The two positioning projections 1012 for engagement with holes 312 in the support 300 are located on a straight line LI which passes through the row of ejection holes in the orifice plate 100 generally at the center thereof and which is parallel to the bottom surface of the tank IT or a reference surface for placement of a carriage surface. The height of the projections 1012 is slightly smaller than the thickness of the support 300. The projections 1012 are engaged with the holes 312 to position the support 300. As viewed in FIG. 5, a lug 2100 engageable with a vertical engaging surface 4002 of a positioning hook 4001 of the carriage is positioned on a production of the straight line L1, so that the force applied for positioning on the carriage acts on a plane containing the straight line L1 and parallel to the above-mentioned reference surface. The arrangement using this relationship is effective because the accuracy with which the ink tank is positioned with respect to the carriage is thereby equalized with the accuracy with which the ejection holes of the recording head are positioned with respect to the carriage, as described later with reference to FIG. 6.

The projections 1800 and 1801 of the ink tank corresponding to the holes 1900 and 2000 for fixing the support 300 to the ink tank side surface are longer than the projections 1012. The projections 1800 and 1801 can therefore pass and project through the support 300. It is possible to fix the support 300 on the ink tank side surface by fuse-fastening the projecting ends of the projections 1800 and 1801. Assuming a straight line L3 perpendicular to the straight line L1 and passing through the projections 1800 and a straight line L2 perpendicular to the straight line L1 and passing through the projection 1801, the center of the supply hole 1200 is generally located on the straight line L3, so that the state of connection between the supply port 1200 and the supply pipe 2200 is stabilized, and so that the load imposed upon the connection between the supply port 1200 and the supply pipe 2200 by an falling impact or the like can be reduced. The straight lines L2 and L3 do not coincide with each other, and the projections 1800 and 1801 are located closer to one of the two projections 1012 which is on the ejection hole side of the recording head. The effect of positioning the recording head with respect to the ink tank is thereby further improved. A curved line L4 generally coincides with an outer wall position of the above-described ink supply member 600 when this member is attached to the ink tank. The projections 1800 and 1801 are disposed along the curved line L4, so that a sufficiently high connection strength and positioning accuracy can be ensured with respect to the weight of the recording head front section. A front end projection 2700 of the ink tank IT is inserted into a hole in a front plate 4000 of the carriage to cope with an abnormal situation where the ink tank is displaced to an extremely large extent. An engaging portion 2101 engages with a further positioning portion of the carriage HC.

After the unit IJU has been attached to the ink tank, the unit IJU is covered with the cover member 800 to be closed except for the downward opening. When the head cartridge is mounted on the carriage provided on the apparatus body, the downward opening is brought closer to the carriage so that the vacant space in the head cartridge is substantially surrounded on every side. Heat developed from the recording head IJH in the surrounded space is uniformly dispersed in this space to effectively maintain this space at a generally constant temperature. However, if the head IJH is continuously driven for a long time, there is a possibility of a slight increase in the temperature. In this embodiment, therefore, a slit 1700 having a width smaller than that of this space is formed in an upper wall of the cartridge to improve natural heat release from the support 300, so that the uniformization of the temperature distribution over the whole of the unit IJU is not influenced by the environment while an excessive increase in temperature is prevented.

When the ink cartridge IJC is assembled as shown in FIG. 4, ink is led to the conduit 1600 in the ink supply passage member through the supply pipe 2200 extending from the supply port 1200 of the ink tank and passing through the hole 320 formed in the support 300 and the inlet hole formed in an inner reverse side wall of the supply passage member 600, flows through the conduit 1600, and then flows into the common liquid chamber through the ink inlet port 1500 of the ceiling plate 1300. At the connection between the supply pipe and the conduit is provided a packing formed of, e.g., silicone rubber or butyl rubber to seal the connected portions, thus completing ink supply passage.

In this embodiment, the ceiling plate 1300 is formed of a resin having improved resistance to ink, such as polysulphone, polyether sulphone, polyphenylene oxide or polypropylene, and is formed simultaneously and integrally with the orifice plate portion 400 in a mold.

As described above, three integrally-molded parts, the ink supply passage member 600, the ceiling/orifice plate member and the ink tank body 1000 are provided, so that the head cartridge can be assembled with high accuracy and can have improved qualities when manufactured in a mass production manner. The number of component parts is reduced in comparison with the conventional head cartridge, and desired improved characteristics can therefore be obtained with improved reliability.

Figure 6:
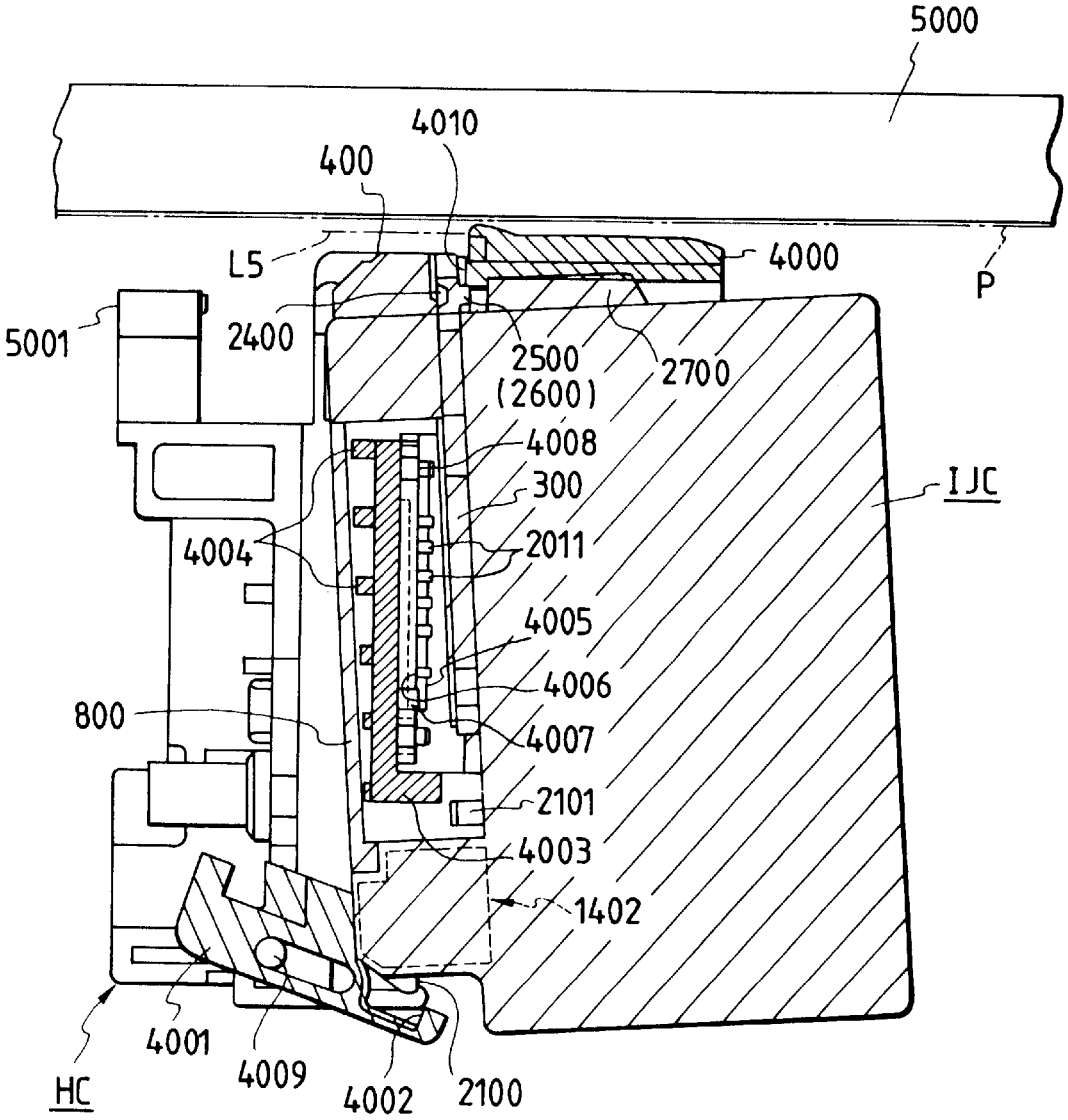
FIG. 6 is a top view illustrating how the recording head cartridge shown in FIG. 3 is mounted on an ink jet recording apparatus.

Referring to FIG. 6, a platen roller 5000 is rotated to move a recording medium P in a direction from the bottom to the top of FIG. 6 by a frictional force. The carriage HC is provided to be moved along the platen roller 5000, and the front plate 4000 (having a thickness of 2 mm) positioned on the front side of the head cartridge IJC is provided on the platen-facing side of the carriage. On the carriage are provided a flexible sheet 4005 having pads 2011 corresponding to the pads 201 of the wiring board 200 of the cartridge IJC, and an electrical connection support plate 4003 which holds rubber pads 4006 having a resiliency force for pressing the flexible sheet 4005 from the reverse side with respect to the pads 2011, and the positioning hook 4001 for fixing the head cartridge IJC in a recording position. The front plate 4000 has two positioning projection surfaces 4010 corresponding to the above-mentioned positioning projections 2500 and 2600 of the cartridge support 300, and receives forces perpendicularly applied to the projection surfaces 4010 after the cartridge has been mounted. The front plate 4000 therefore has a plurality of reinforcement ribs (not shown) projecting in the direction of the perpendicular forces on the platen roller facing side. These ribs also serve as head protection projections by protruding to a small extent (about 0.1 mm) beyond the position of the front side of the cartridge IJC (indicated by line L5 in FIG. 6) when the cartridge IJC is mounted. The electrical connection support plate 4003 has a plurality of reinforcement ribs 4004 extending in the direction perpendicular to the projection plane of FIG. 6, and its thickness in the direction parallel to the platen roller 5000 is gradually reduced from the platen roller side to the hook 4001 side, which arrangement enables the cartridge to be set in a slanted position when mounted, as illustrated. The support plate 4003 also has a platen-roller-side positioning surface 4008 and a hook-side positioning surface 4007 for stabilization of the electrical contact state. A pad contact region is defined between these positioning surfaces, and the extent of deformation of the rubber sheet having protrusions corresponding to the pads 2011 is determined by these positioning surfaces. These positioning surfaces are brought into contact with surfaces of the wiring board 200 when the cartridge IJC is fixed in a position such as to enable recording. Further, in this embodiment, the pads 201 of the wiring board 200 are distributed so as to be symmetric with respect to the line L1, so that the extent of deformation of the protrusions of the rubber sheet 4006 are made even, thereby further stabilizing the pressure for maintaining the pads 2011 and 201 in contact with each other. In this embodiment, the pads 201 are distributed in two upper and lower rows and in two vertical rows.

The hook 4001 has an elongated hole for engagement with a fixation shaft 4009. The hook 4001 is rotated counterclockwise from the position shown in FIG. 6 by utilizing the movement space in this elongated hole and is thereafter moved leftward parallel to the platen roller 5000, thereby positioning the ink jet cartridge IJC on the carriage HC when the cartridge IJC is mounted. This movement of the hook 4001 may be effected by any means. However, it is preferable to move the hook 4001 by a lever or the like. In any case, as the hook 4001 is rotated, the cartridge IJC is moved toward the platen roller and is simultaneously moved to a position such that the positioning projections 2500 and 2600 can be brought into contact with the positioning surfaces 4010 of the front plate and, as the hook is moved to the left, the cartridge IJC the vertical hook surface 4002 is rotated on the region of contact between the positioning surfaces 2500 and 4010 along a horizontal plane while the vertical hook surface 4002 is maintained in close contact with a vertical surface of the lug 2100 of the cartridge IJC. Finally, the pads 201 and 2011 are thereby brought into contact with each other. When the hook 4001 is held in the fixed position, a complete contact state of the pads 201 and 2011, complete surface contact between the positioning surfaces 2500 and 4010, two-surface contact between the vertical surface 4022 and the vertical surface of the lug 2100, and surface contact between the wiring board 200 and the positioning surfaces 4007 and 4008 are established, thereby completely fitting the cartridge IJC on the carriage.

Figure 7:
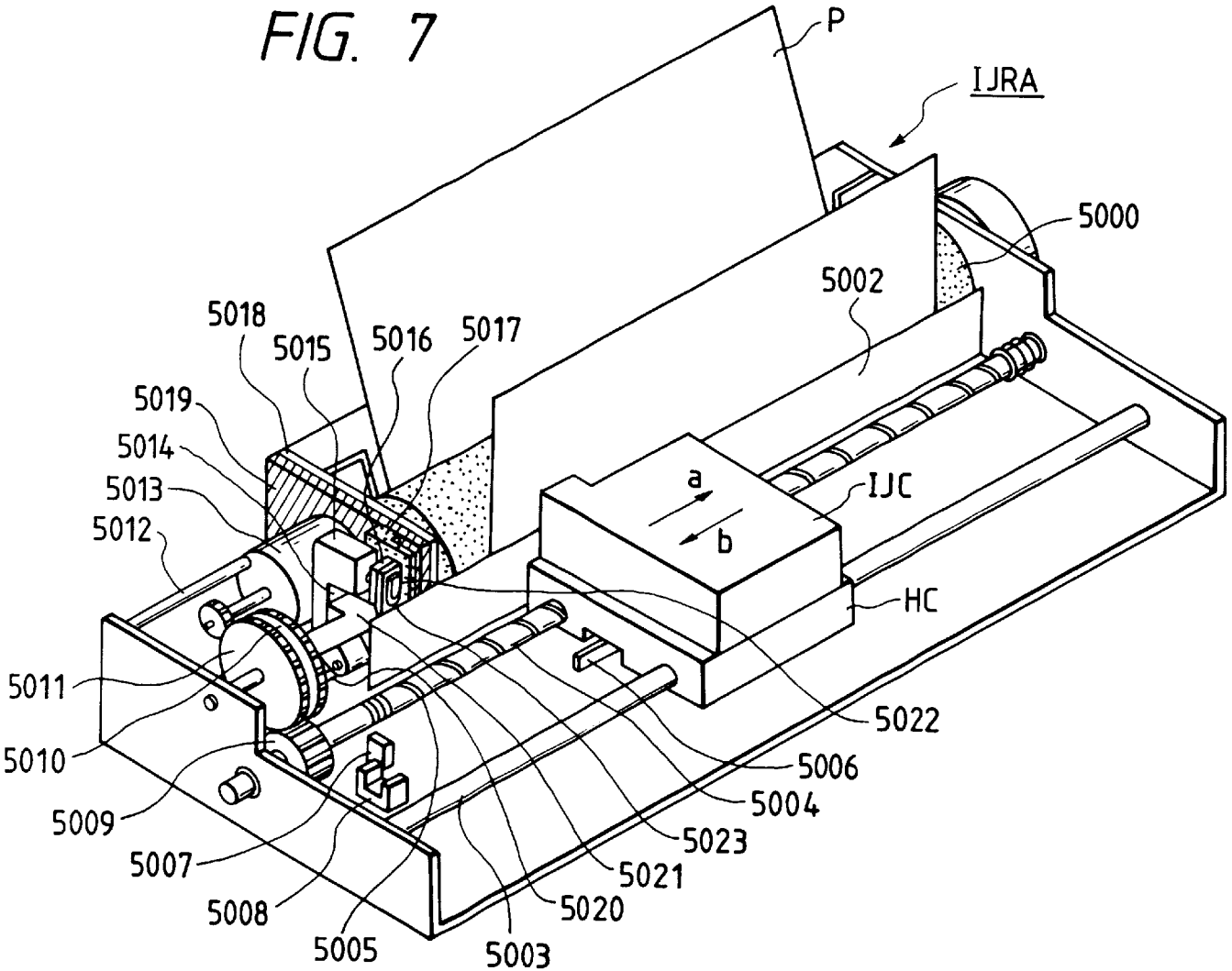
FIG. 7 is a perspective view of the ink jet recording apparatus for performing recording with the recording head.
Figure 8A:
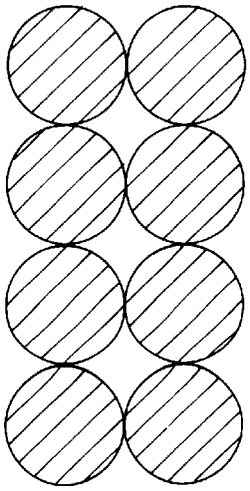
FIGS. 8A and 8B are schematic views explaining the problem involving the dot formed by the second discharge in the continuous discharge.
Figure 8B:
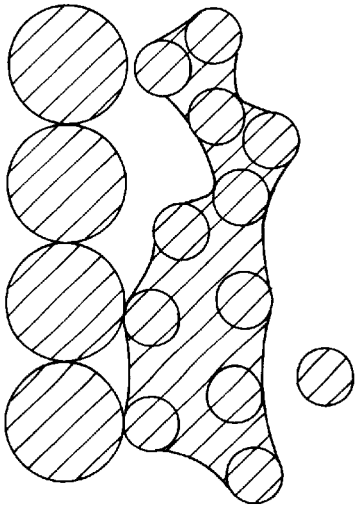

FIG. 7 is a schematic perspective view of the ink-jet recording apparatus IJRA to which the present invention is applied. Normal/reverse rotation of a driving motor 5013 is transmitted to a lead screw 5005 through driving force transmission gears 5011 and 5009. By the rotation of the lead screw 5005, the carriage HC is reciprocatively moved in directions a and b through a pin (not shown) of the carriage HC in engagement with a helical groove 5004 of the lead screw 5005. A paper retaining plate 5002 serves to press a recording paper sheet against the platen 5000 over a range along the direction of carriage movement. Photocouplers 5007 and 5008 operate in association with a lever 5006 and confirms the position of the carriage HC when the lever 5006 is located between them to start changing the direction of rotation of the motor 5013 or the like. A member 5016 supports a cap 5022 with which the front side of the recording head is capped. A suction means 5015 constituted of a pump or the like draws ink or air in the internal space of the cap through an opening 5023 in the cap to effect a recording head ejection recovery operation. A cleaning blade 5017 is moved to and fro by a member 5019 which is supported on an apparatus body support plate 5018. The blade 5017 is not limited to the illustrated type; a different well-known cleaning blade can, of course, be applied to this embodiment. A lever 5021 is operated to start the evacuating operation for ejection recovery. During the movement of the carriage HC, the lever 5021 is moved according to the movement of a cam 5020 engaging with the carriage HC. This movement is effected by transmitting the driving torque form the driving motor through a well-known transmission means such as a clutch.

The operations of capping, cleaning and suction recovery can be started at certain positions with respect to the rotation of the lead screw 5005 and the rotational position of the groove 5004 thereof when the carriage HC is moved into a home position region. Needless to say, for each operation, well-known suitable timing is used.

Details of the present invention applicable to the above-described arrangement described shown in FIGS. 3 to 7 will be described below with reference to FIGS. 1, 2, and 6 and other subsequent figures.

Figure 2:
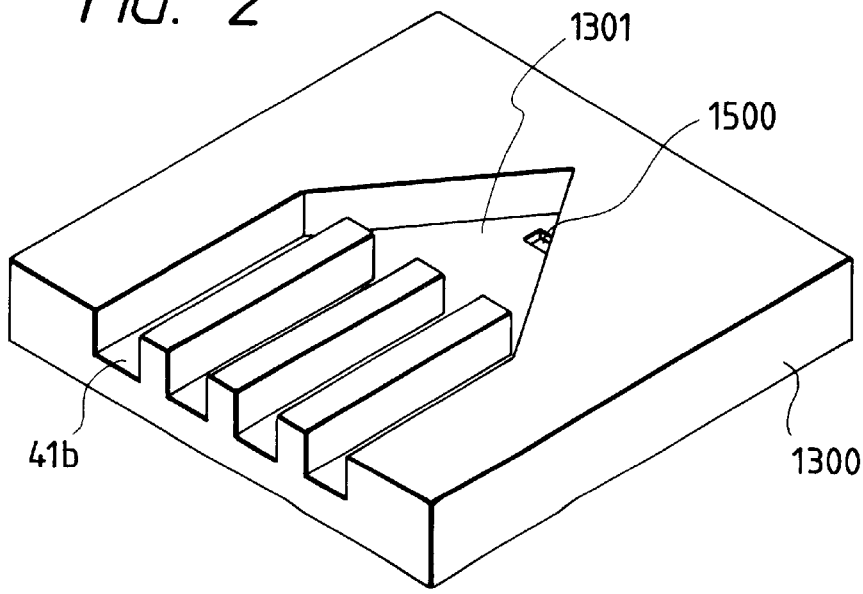
FIG. 2 is a perspective view of a ceiling plate as seen when looking from the rear side thereof.

FIG. 2 shows a schematic exploded perspective view of the ceiling plate 1300 with grooves (ceiling member with recesses) formed integrally with the orifice plate 400 and the heater board 100 shown in FIG. 3, and a perspective view of the ceiling plate seen from the reverse side. As described above, ejection holes (orifices) 41 are formed in the orifice plate having a maximum thickness of 200 $\mu$m, and ink receiving port 1500 is provided to supply ink to the common liquid chamber formed by combining the ceiling plate 1300 with grooves and the heater board 100. Heaters, i.e., electrothermal conversion elements 91 generate thermal energy utilized to eject ink. The common liquid chamber is filled with ink supplied through the ink receiving port 1500.

In this type of recording head, there is a possibility of fine bubbles staying in the liquid passages and the common liquid chamber for various reasons, not being discharged or disappearing, and staying by growing to a certain size in the common liquid chamber. Bubbles in the common liquid chamber do not always badly influence the head operation. However, if bubbles are excessively collected in the chamber or if the volumes of bubbles is excessively large, they may clog in the liquid passages so that the desired flow rate of the liquid passages cannot be maintained, or may change the direction of ink ejection or the amount of ejected ink. It is therefore preferable to minimize the amount of bubbles mixed in ink in the common liquid chamber by the ejection recovery operation which is performed at the time of ejection failure (suction recovery operation utilizing a negative pressure in this embodiment).

In this embodiment, to enable bubbles in the common liquid chamber to be effectively removed, the common chamber is formed into a triangular shape, as shown in FIG. 2. That is, the ink flow rate along a wall surface is zero when ink flows to the ink passages or the ejection holes during suction operation for ejection recovery. Accordingly, to uniformly draw ink in the common liquid chamber so as to remove bubbles staying therein, it is necessary to minimize common liquid chamber walls having a shape such as to be generally parallel to an ink flow caused during suction operation. Also, it is undesirable for the chamber to have a shape such as to obstruct ink flows. Consequently, a triangular shape which enables ink to be led to the ink passages though the shortest courses can be selected as shapes preferred rather than a round or angular shape, e.g., a circular or a rectangular shape.

Figure 10:
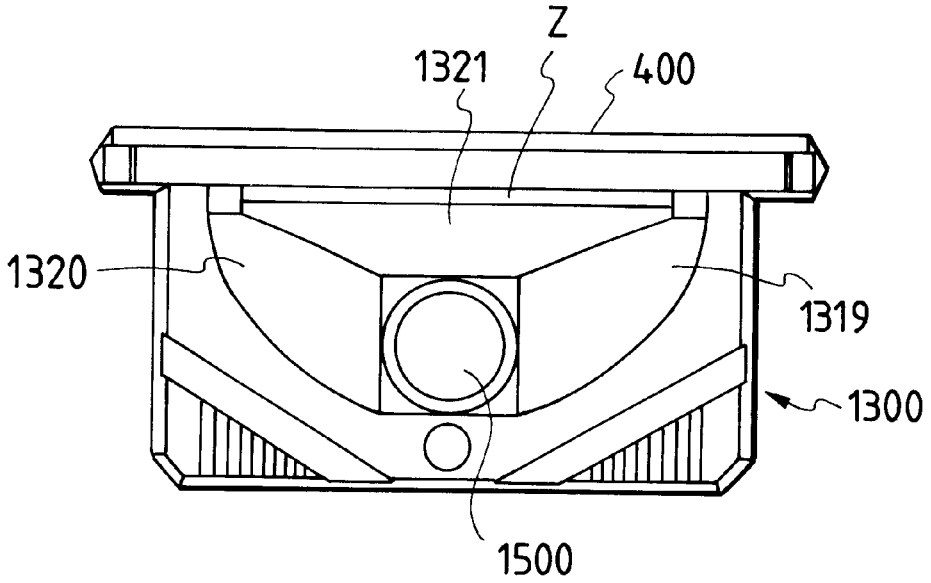
FIG. 10 is a plan view illustrating the ceiling plate which is the component of the recording head according to the present invention.
Figure 11:
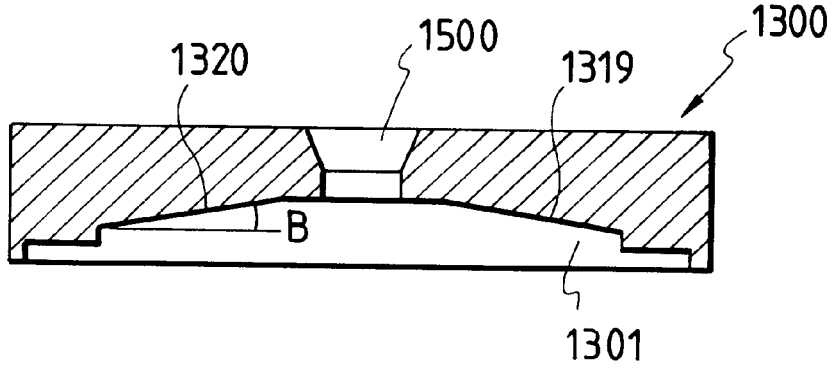
FIG. 11 is a cross-sectional view of the ceiling plate shown in FIG. 10 as seen when looking in the direction of the discharge port array.
Figure 12:
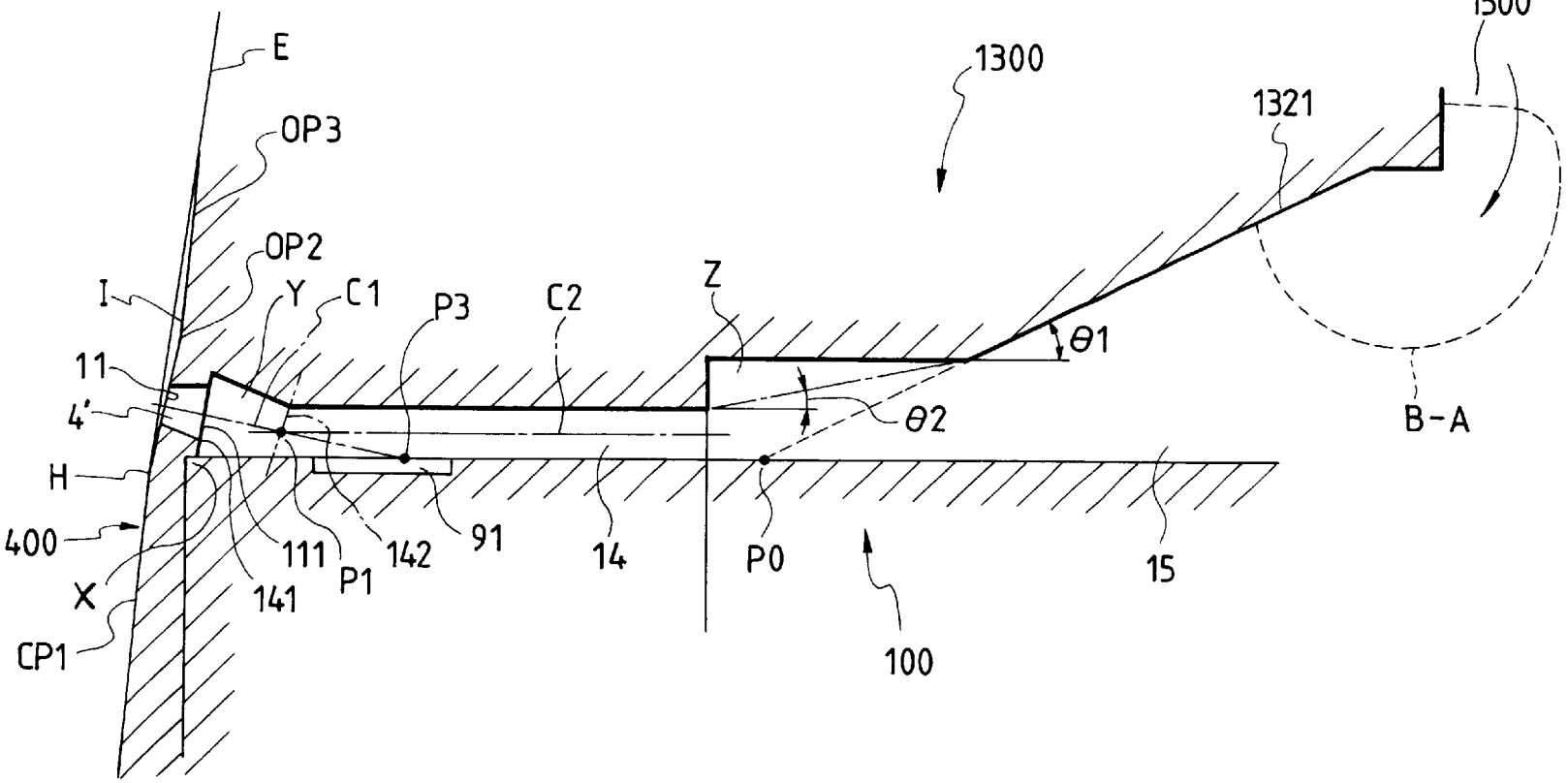
FIG. 12 is a cross-sectional view taken in the direction of ink discharge illustrating connection between the ceiling plate shown in FIG. 10 and a substrate.

FIGS. 10, 11, and 12 show details of the ceiling plate shown in FIG. 2.

FIGS. 10, 11, and 12 are a plan view of the ceiling plate seen from the reverse side, a cross-sectional view of the ceiling plate 1300 along the direction in which ejection holes are arranged, and a cross-sectional view of the ceiling plate 1300 along the ejection direction, respectively.

In FIGS. 10 to 12 are illustrated the ink receiving port 1500 to which the above-described conduit 1600 is connected to supply ink to the common liquid chamber 15, the orifice plate 400 in which ejection holes are formed, the ink passage 14 including a region for thermal action of heater 91, a common liquid chamber wall surface 1321 extending from the ink receiving port 1500 to the ink passage 14, and inner wall surfaces 1319 and 1320 on the left and right hand sides of the surface 1321. The slant wall surfaces in this embodiment are flat surfaces, as can be understood from these figures. However, they are not limited to flat surfaces, and, specifically, the left and right surfaces 1319 and 1320 may have a small curvature.

As can be clearly understood from the above, the common liquid chamber 15 has, on the ink receiving port 1500 side, a region Z formed continuously from each liquid passage 14 so as to be increased in sectional area in comparison with the liquid passage 14 and the slant surface 1321 extending from the ink receiving port 1500 to the region Z, and a production of the slant surface 1321 meets a position $P_0$ on the surface of the substrate 100. In this embodiment, the angle between the slant surface 1321 and a center line $C_2$ of the ink passage is 22° while the angle of each of the left and right inner wall surfaces 1319 and 1320 from the same line is 15°.

Fine bubbles are collected in the region Z, and collected bubbles are maintained in a region at a distance from a production of each liquid passage 14 at which the heater 91 is disposed. Further, bubbles are increased in size, they can be led along the slant surfaces in a direction such as to be remoter from the liquid passages 14. Consequently, occurrence of ejection failure can be retarded to a large extent. Moreover, in this arrangement, the production line of one slant surface meets point P on the substrate 100 surface facing the region Z, so that when bubbles existing in the common liquid chamber 15 are moved along the slant surface by some impact to enter the liquid passages 14, the substrate 100 existing as a barrier prevents large bubbles from entering the liquid passages 14 to cause ejection failure.

As described above, by the effect of the shape of the common liquid chamber in accordance with the present invention, bubbles which have entered the common liquid chamber 15 and have dispersed can be collected so that a bubble B-A can easily be formed. Bubbles in the common liquid chamber 15 can easily be moved to the liquid passages 14 along the slanted inner wall surfaces by an ink flow formed by suction or pressurization at the time of ejection recovery operation. By this effect, as well as the effect of the triangular shape of the common liquid chamber, discharge bubbles can easily be discharged through the ejection holes during ejection recovery operation. It is thereby possible to prevent recording failure and a reduction in the life of the recording head due to bubbles staying in the common liquid chamber and other places.

Specifically, bubble discharge directions can be centralized to one side by increasing the inclination of the left and right inner wall surfaces 1319 and 1320 relative to that of the slant surface 1321 to optimize the arrangement, thereby further improving the bubble removing efficiency.

There is a risk of bubbles in the common liquid chamber-being entirely discharged, if the common liquid chamber is shaped in the above described manner so that bubbles in the liquid chamber can be discharged more easily. That is, in the case of a recording head arrangement having no liquid chamber buffer as in this embodiment (common liquid chamber arrangement), if all bubbles in the common liquid chamber are removed, the time taken to refill ink between first and second ejection operations in a continuous ejection process is increased, so that ink droplets for the second ejection cannot be suitably formed, and there is a possibility of a reduction in image quality. In this embodiment, a bubble formation control is performed as described below to solve this problem.

Bubbles in the common liquid chamber disappear by the ejection recovery operation. Accordingly, in accordance with this embodiment, a bubble formation control may be performed after each suction operation so that bubbles having a suitable size, i.e., bubbles which do not badly influence and which can act as a buffer are formed in the common liquid chamber while the amount, size and so on of the bubbles are controlled.

(First Embodiment)

In the first embodiment of the present invention, fine air bubbles are generated by directly heating ink using a discharge heater 91. The lowest desired heating temperature is that temperature at which the ink initiates nucleate boiling. The ink which has been heated to this boiling point generates fine air bubbles in the ink passage 14. With generation of fine air bubbles due to vaporization of gas dissolved in the ink or of water contents of the ink taken into consideration, the heating temperature generated by the heater 91 may be from 60° C. to 80° C. However, such a heating temperature should be determined on the basis of various conditions including the time that can be allocated to the air bubble generation process conducted after the discharge recovery process in the ink jet recording apparatus. The fine air bubbles generated in the liquid passage 14 are pushed out of the liquid passage 14 by the subsequent air bubbles and part thereof moves into the common liquid chamber 15. In the common liquid chamber 15, the fine air bubbles gather in a predetermined portion thereof due to the structure of the common liquid chamber which has been described in connection with FIGS. 10 through 12 and thereby form an air bubble having a predetermined size. Hence, it is possible to control the size of the air bubbles which stay (i.e., do not disappear during recording) in the common liquid passage by controlling the energy level of the electric pulses applied to the discharge heater 91 and application time. Although the diameter of the air non disappearing bubbles which remain in the common liquid passage and serve as buffers of ink pulsation caused by discharge of ink differs depending on the size of the recording head, it is between 100 $\mu$m to 300 $\mu$m in the recording head of this embodiment. Also, in the recording head having the common liquid chamber structure in which an air bubble B-A stays near the ink receptacle 1500, as shown in FIG. 12, the cross-sectional area of the air bubble is preferably 60% or less, more preferably, 20 to 50%, of the area of the ink receiver 1500 with fluidity of the ink supplied from the ink tank in the common liquid chamber.

Figure 9A:
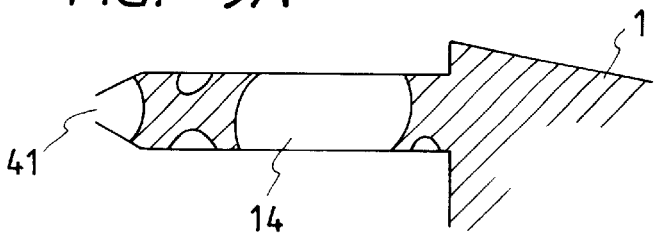
FIGS. 9A and 9B are schematic cross-sectional views explaining removal of the air bubbles remaining in the liquid passage.
Figure 9B:
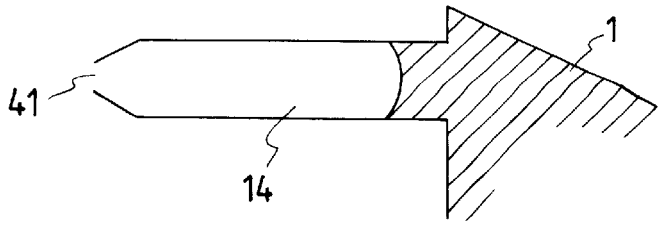

The air bubbles which remain in the liquid passage after the aforementioned air bubble generation process has been executed and which have grown to a certain size are discharged by idle discharge. FIG. 9A shows an example of how air bubbles remain in the liquid passage. FIG. 9B shows another example of how air bubbles remain in the liquid passage. In the state shown in FIG. 9B, ink is refilled due to capillary phenomenon. That is, idle discharge is conducted in a state wherein the air bubbles are present in the liquid passage to discharge the ink located at the forward portion of the liquid passage together with the air bubbles and thereby obtain a state in which ink can be refilled in the liquid passage due to capillary force. Consequently, ink is refilled in the liquid passage and the recording head is made ready for use for recording. However, there is a possibility that fine air bubbles are present in the ink in the liquid passage. Hence, idle discharge is preferably executed a plurality of times to discharge such fine air bubbles.

Another effective method of discharging the air bubbles in the liquid passage is to conduct idle discharge alternately on the even-numbered discharge ports and on the odd-numbered discharge ports. In this method, the air bubbles which stay between the adjacent discharge ports in the liquid passage are discharged. This method has been proposed in, for example, European Patent Publication No. 0,451,827.

In this embodiment, air bubble generation is executed after suction recovery. However, it may be conducted to generate in the common liquid chamber an air bubble which can serve as a buffer after the air bubbles in the common liquid chamber have been discharged, e.g., after the ink discharge process has been executed by means of the ink discharge means, for example, by pressurizing the ink in the liquid passage.

Furthermore, in this embodiment, the discharge heater which exhibits less variations in the amount of heat generated is used also as the heating means. However, any means that can heat ink can be used, as will be described in detail in the subsequent embodiments.

As mentioned above, by heating the ink after the ink discharge process has been executed, adequate air bubbles which do not adversely affect discharge can be reserved in the common liquid chamber. Consequently, discharge energy (pressure waves) directed toward the common liquid chamber during discharge can be absorbed by expansion and contraction of these air bubbles, and the effect of ink pulsation caused by discharge and directed to the ink tank can be restricted. As a result, delay of refilling which occurs after the first discharge in the continuous discharge can be restricted without using a special liquid chamber buffer.

(Second Embodiment)

Another embodiment capable of lessening thermally adverse effect and effectively generating air bubbles in the common liquid chamber will be described below.

When air bubbles are generated by heating ink and thereby causing ink to boil, the higher the density of energy applied to the heating means, the lesser the thermally adverse effect.

That is, predetermined air bubbles may also be generated by heating the ink at a low energy level for a long period of time. However, heating of the ink for a long time increases the temperature of not only the heater board 100 which is in direct contact with the ink but also of the support member 300 made of metal and of other components of the recording head which have a large heat capacity, thus increasing the amount of energy required to generate air bubbles. Furthermore, temperature drop of the components having a large heat capacity is far slower than that of the components having a small heat capacity. In the ink jet recording head, since the discharge rate of the ink changes in proportion to the temperature of the ink, an increase in the temperature of the components having-a large heat capacity prolongs the time when this change in the discharge rate occurs. In other words, an increase in the temperature of the components having a large heat capacity precludes formation of dots having a uniform diameter and thus degrades the image quality.

An example of a head driving circuit and an example of increasing the energy density in this circuit will be described below.

Figure 13:
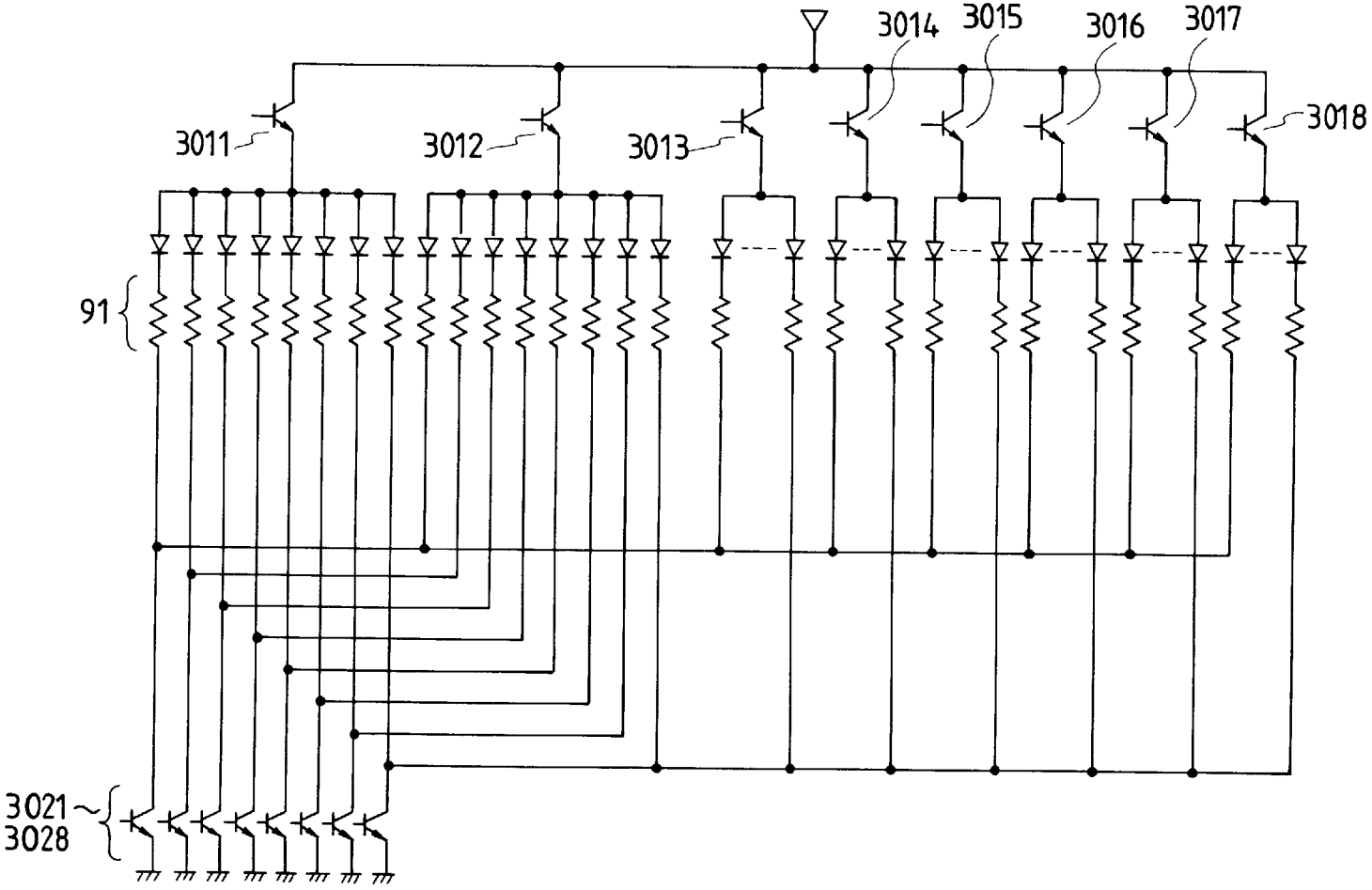
FIG. 13 is a circuit diagram of a recording head driving circuit.

FIG. 13 is a circuit diagram of a driver circuit for driving the heaters 91 provided for the individual 64 discharge ports. Simultaneous drive of 64 heaters 91 without generating voltage drop requires a large power source capacitance. Hence, the discharge ports are divided into blocks, and are sequentially driven in the unit of blocks by predetermined delay time intervals. If one block consists of, for example, eight discharge ports, the number of blocks is eight, and the number of heaters that are driven at one time is eight. The blocks are driven in sequence by predetermined time intervals. Such a block drive does not require 64 drivers to drive 64 discharge port heaters 91. In this embodiment, 64 heaters are selectively driven by turning on and off 8 drivers (common drivers 3011 through 3018) for making a selection on the driver blocks and 8 drivers (segment drivers 3021 through 3028) for making a selection on the 8 heaters 91 in each block, as shown in FIG. 13.

In this embodiment, heating of the ink is performed using the aforementioned block drive method in the manner described below.

In this embodiment, the level of energy applied to a single heater during recording is 3.5 W (150 mA×23V×7 μsec). Application of this energy level to the heater generates film boiling on the heater, thus generating air bubbles. The energy of these air bubbles is used to discharge ink droplets from the discharge port for recording. Discharge frequency is 3 KHz.

If the level of energy applied to the heater during the air bubble generation process is the same as that of energy applied during recording, ink is discharged, and non-heated ink is thus supplied from the common liquid chamber, decreasing the temperature of the ink in the liquid passage, i.e., the ink in the liquid passage cannot be heated, and generation of air bubbles becomes difficult.

To avoid this problem, energy having a level which ensures that no discharge occurs may be applied to the heater 91. This is achieved by decreasing the voltage or current applied to the heater 91. However, in this method, the time required to heat the ink is increased, and the aforementioned thermally adverse effect occurs.

In this embodiment, the application time of the pulses applied to the heater and the drive frequency are utilized to solve the aforementioned problem. That is, in this embodiment, pulses having a pulse duration less than half that of the pulses applied during recording (the duration which is less than half 7 μsec) are applied in the air bubble generation process. Reduction in the level of energy applied caused by halving the pulse duration is compensated for by increasing the drive frequency. In this way, the temperature of the ink in the ink passage can be increased for a short period of time without ink being discharged. In other words, by minimizing an increase in the temperature of the components having a large heat capacity, thermally adverse effects can be kept to a minimum and generation of predetermined air bubbles in the common liquid chamber is made possible.

The head driving circuit of this embodiment may also be controlled in the manner described below.

Figure 14:
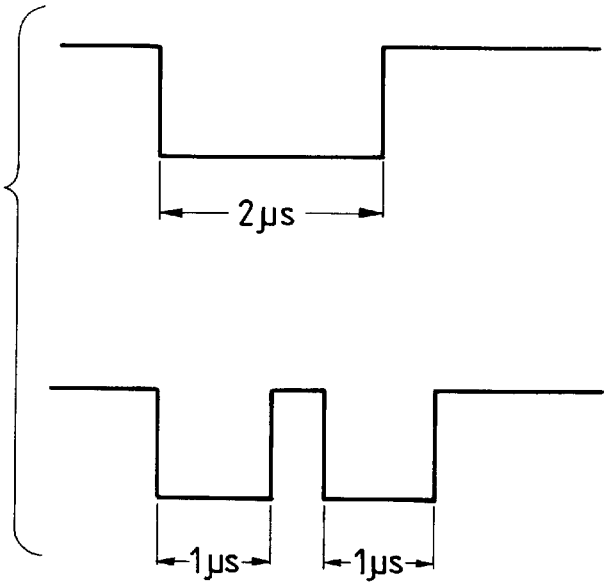
FIG. 14 show waveforms of discharge heater driving pulses used fort he air bubble generation process.

In the case of application of a pulse having a pulse duration of, for example, 2 μsec, a single pulse having a pulse duration of 2 μsec may be applied. However, when the same level of energy is applied, the time at which ink discharge occurs can be further delayed by application of two pulses in sequence having a total pulse duration of 2 μsec with a pulse non-applied time therebetween, as shown in FIG. 14. Practically, the following control is performed.

In the drive circuit shown in FIG. 13, since a larger current flows in the common drivers 3011 through 3018 than in the segment drivers 3021 through 3028, it takes a longer time for the common drivers to be turned off. It was found in the experiments that it took 1 μsec or less for the driver having a rated value of several hundreds of mA, such as the segment driver, to be actually turned off after turning off of the driver has been controlled while it took about ten μsec for the driver having a rated value of several A, such as the common driver, to be actually turned off after turning off the driver has been controlled. That is, if the time interval at which the blocks are driven is 10 μsec or more, the heater in the first block is turned off when the common driver 3011 and the segment driver 3021 are turned off. At that time, if the second block is turned on within 10 μsec after the common driver 3011 and the segment driver 3021 have been turned off, since turning off of the common driver for the first block is not completed, the first and second blocks are turned on simultaneously.

Practically, to generate predetermined air bubbles in the common liquid chamber, the pulse duration of the pulse applied to turn on the heater is set to 1 μsec, the time intervals at which the blocks are driven are set to 10 μsec, the level of energy applied is set to 3.5 W, which is the same as that applied during recording, the drive frequency is set to 20 KHz, and the total control time is set to 1.0 sec. When the time intervals at which the two blocks are driven are 10 μsec, drive of a subsequent block begins before turning off of the common driver for driving the previous block is completed, and the heaters in the previous block and the heaters in the subsequent block are thus driven at the same time. This means that, although the pulse duration is 1 μsec, each of the heaters is turned on in a single drive period actually for 2 μsec, resulting in an increase in the energy density. Also, as compared with the case in which the pulse width is initially set to 2 μsec, since there is a pulse non-applied time and a pulse is not applied continuously for 2 μsec, the same level of energy as that in the case of continuous application can be applied while discharge of ink can be delayed.

(Third Embodiment)

Another embodiment of generating air bubbles in the common liquid chamber will be described below.

In the aforementioned embodiments, energy is applied to the ink using the discharge heater. However, air bubbles can also be generated by using the heating means other than the discharge heater. In the ink jet recording head, since the discharge rate of the ink droplets changes in accordance with the temperature of the recording head (ink), as mentioned above, a heater for heating the recording head or for maintaining the temperature of the recording head (hereinafter referred to as a sub-heater) is generally provided in addition to the discharge heater.

Air bubbles serving as buffers can be generated in the common liquid chamber in the similar manner to that of the case of the aforementioned embodiments by turning on this sub-heater after recover is completed. In an apparatus in which the number of dots discharged using the discharge heater before the life of that discharge heater matures must be increased, the use of the discharge heater for the air bubble generation process decreases the life of that discharge heater. The use of the sub-heater can eliminate such a drawback.

A sub-heater which is in direct contact with the ink is more desirable from the viewpoint of effective air bubble generation. The sub-heater mentioned in this embodiment may be a heater formed, together with the discharge heater, on a substrate which constitutes the recording head, or a heater provided outside of the recording head, e.g., on the support member of the head. Any way, any means for heating the ink and for maintaining the temperature of the ink can be used.

Figure 15:
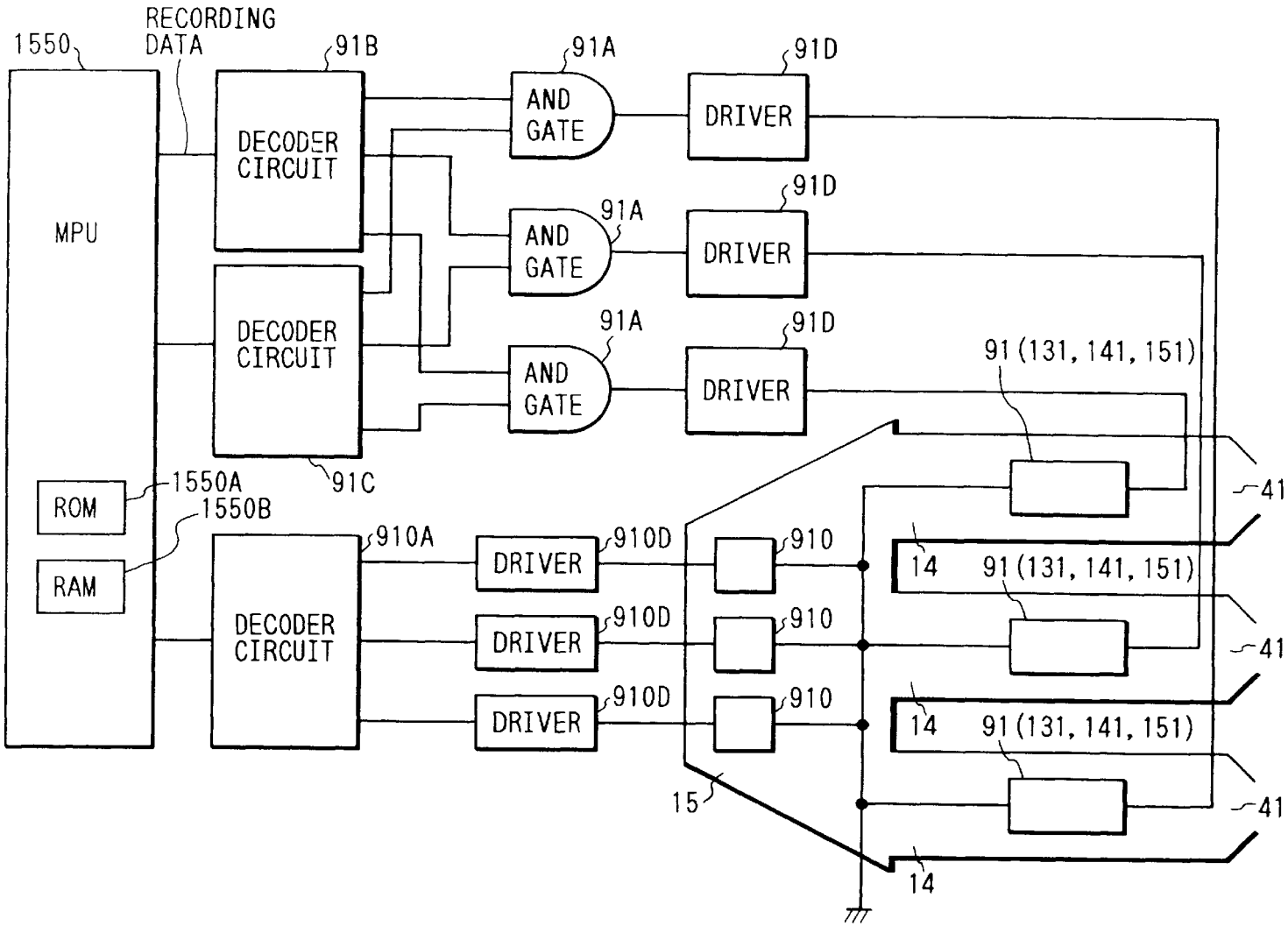
FIG. 15 is a block diagram showing the structure for driving the discharge heaters and heaters for maintaining the temperature of the head.

FIG. 15 is a block diagram showing an example of a drive control configuration for driving the discharge heater or sub-heaters. In FIG. 15, only three discharge ports 41 and the corresponding three discharge heaters 91 are shown to simplify illustration.

In the liquid passage 14 and the common liquid chamber 15, the discharge heaters 91 and the sub-heaters 910 for controlling the ink temperature are respectively provided. Also, drivers 91D and 910D for respectively driving the discharge heaters 91 and the sub-heaters 910 are provided. The discharge heaters 91 are driven by the AND signal obtained from both the pulse width signal generated by a pulse width generating circuit 91C on the basis of the pulse width data from the MPU 1550 and the discharge signal generated by a decoder circuit 91B on the basis of the recording data (discharge data) from the MPU 1550. In this way, the pulse duration and the drive frequency can be changed between during ink discharge and during air bubble generation, as mentioned above. The sub-heaters 910 are driven by a drive signal generated by a decoder circuit 910A on the basis of the drive data from the MPU 1550. The MPU 1550 transfers the recording data, the pulse width data and the drive data on the basis of the processing programs stored in the ROM 1550A. At that time, the RAM 1550B serves as the work area for executing the programs.

In addition to the discharge heater or sub-heater, any means capable of applying energy to the ink can be used as the ink heating means.

Energy suitable to generate predetermined air bubbles in the common liquid chamber changes with the temperature of the recording head (temperature of the ink) including that of the environment of the recording head and an increase in the temperature of the recording head caused by recording. Hence, means for detecting the ambient temperature or the temperature of the recording head and for changing the energy to be applied to the heater to generate air bubble on the basis of the detected temperature may be provided. This can be achieved by the same structure as the known one for changing the energy to be applied to the discharge heater in accordance with the ambient temperature or the temperature of the recording head.

Furthermore, in this embodiment, the discharge heater or the sub-heater for maintaining the temperature of the recording head is used as the heating means used for air bubble generation. However, these two types of heaters may be used in combination to generate air bubbles. In this way, generation of air bubbles having an adequate size in an adequate time and restriction of the aforementioned thermally adverse effect can be made easier.

In this and previous embodiments, air bubble generation is performed after the air bubbles in the common liquid chamber have been discharged by, for example, discharge recovery. Air bubble generation may also be performed at the following time. A desired time for the air bubble generation process is immediately after the discharge recovery process and immediately before recording. In such an air bubble generation process, air bubbles which can function as buffers when ink discharge is conducted for recording can be reliably generated, and the size of the air bubbles can be easily controlled. However, when the recording head is not used for a long time, air bubbles may enter the liquid passage or common liquid chamber. These air bubbles gradually grow to a certain size. Particularly, in the common liquid chamber having the aforementioned tapered form, these air bubbles may gather to form the same air bubbles as those mentioned in the aforementioned embodiments. It was found in the experiments that it took about one second for an air bubble having a diameter of 1 $\mu$m to be generated in such a way and that it took three days for such an air bubble to grow into an air bubble of 100 $\mu$m As mentioned above, air bubbles having a certain size may be present in the common liquid chamber when the recording apparatus has not been used for a long time. In such a case, if the size of the air bubbles has been confirmed beforehand in an experiment, desired air bubbles may be obtained by driving the heating means in accordance with the size of the generated air bubbles immediately before recording, thus eliminating the discharge recovery operation to be conducted before recording.

Where the heater other than the discharge heater, such as the sub-heater, is used as the heating means used for air bubble generation, the present invention can also be applied to an ink jet recording head of the type which employs a discharge energy generation element other than that which employs heat energy, such as a piezoelectric element.

Another example of a recording head cartridge to which the present invention can be applied and of an ink jet recording apparatus employing the same will be described below.

Figure 16:
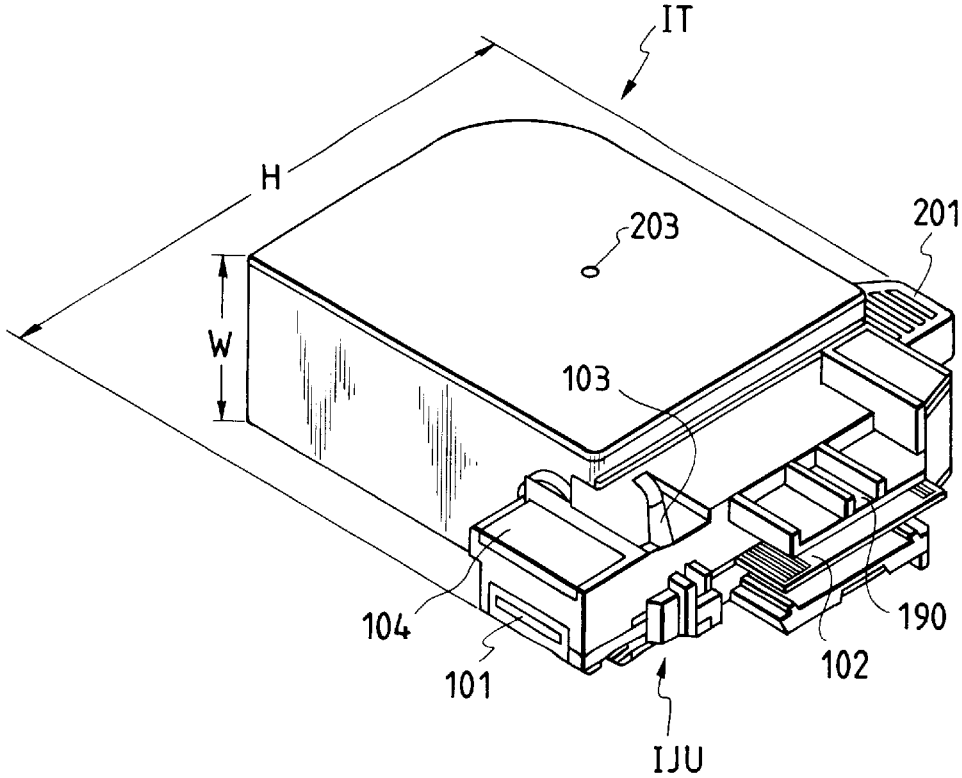
FIG. 16 is a perspective view of a recording head cartridge to which the air bubble generation process according to the present invention can be applied.
Figure 18:
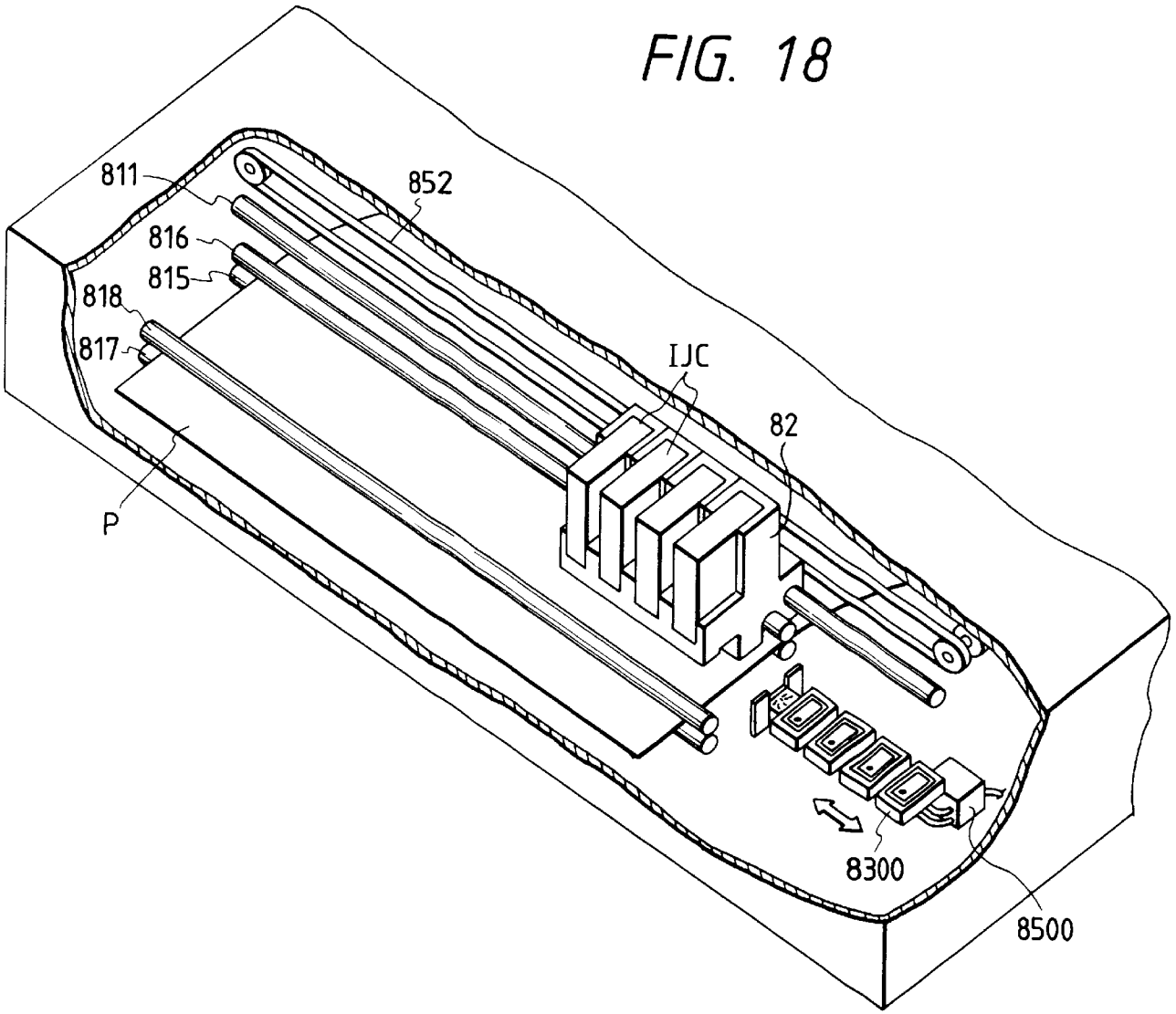
FIG. 18 is a perspective view of the ink jet recording apparatus for performing recording using the recording head cartridge shown in FIGS. 16 and 17.

FIG. 16 shows a head cartridge which can be mounted on a carriage of an ink jet recording apparatus shown in FIG. 18. The cartridge shown in FIG. 16 has an ink tank unit IT and a head unit IJU. The ink tank unit IT and the head unit IJU are formed as one unit and are made removable from each other. A connector 102 for receiving signals which drive an ink discharge portion 101 of the head unit IJU and for outputting a remaining ink detection signal are provided at a position where it is in alignment with the head unit IJU and the ink tank unit IT. This allows height H and thickness of the cartridge when it is mounted on the carriage, which will be described later, to be reduced. This in turn allows the size of a carriage on which the cartridges are to be disposed in a row in the manner described later in connection with FIG. 18 to be reduced.

To mount the head cartridge on the carriage, the operator grips a knob 201 provided on the ink tank unit IT in a state where a discharge portion 101 is directed downward and locates the head cartridge on the carriage. The knob 201 is brought into engagement with a lever provided on the carriage for making the cartridge mounted on the carriage. When the carriage is mounted, a pin provided on the carriage is brought into engagement with a pin engaging portion 103 of the head unit IJU, by which the head unit IJU is positioned.

In the head cartridge shown in FIG. 16, an absorber 104 for cleaning a member for wiping the surface of the ink discharge portion 101 to clean it is provided in alignment with the ink discharge portion 101. Also, an air introducing hole 203 through which air is introduced into the ink tank when the level of the ink in the ink tank unit is lowered is formed essentially at the center of the ink tank unit IT.

Figure 17:
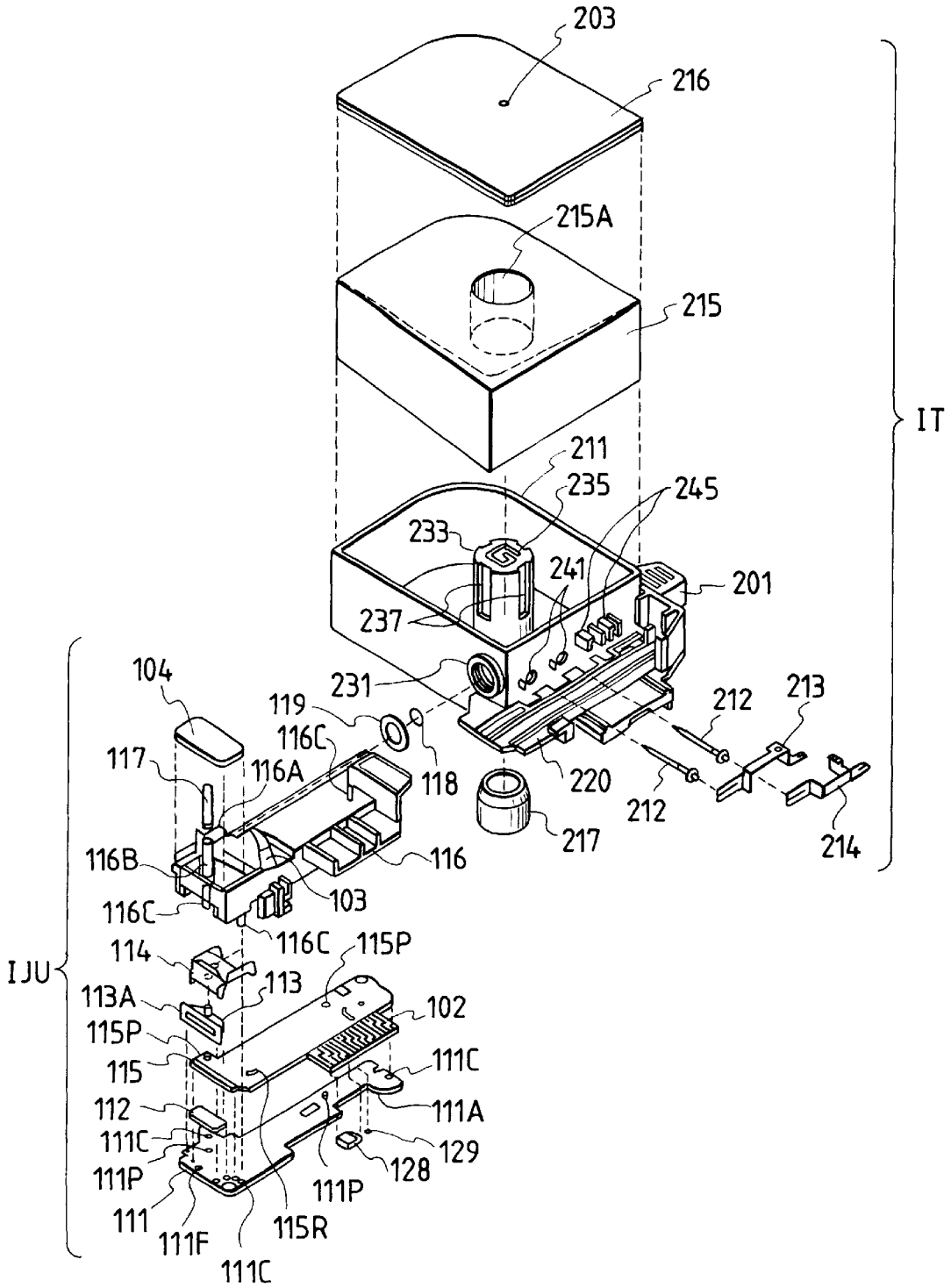
FIG. 17 is an exploded perspective view of the recording head cartridge shown in FIG. 16.

FIG. 17 is an exploded perspective view of the head cartridge shown in FIG. 16. The head cartridge shown in FIG. 17 has the head unit IJU and the ink tank unit IT. The individual units will be described in detail below with reference to FIG. 17.

Head Unit

A base plate 111 formed by Al or the like serves as a reference for fabrication of the individual components of the head unit IJU. Above the base plate 111 are fabricated a substrate 112 on which a group of elements for generating energy utilized for ink discharge is formed and a printed circuit board (PCB) 115 on which interconnections for supplying power to the elements are formed. The substrate 112 and the printed circuit board 115 are interconnected with each other by wire bonding or the like. The elements formed on the substrate 112 are electrothermal energy conversion elements for generating heat energy required to generate film boiling in the ink when energized. Hereinafter, the substrate 112 is referred to as a heater board.

The aforementioned connector 102 forms part of the PCB 115. A drive signal from a control circuit (not shown) is received by the connector 102 and is then supplied to the heater board 112. In this embodiment, the PCB 115 is a two-side printed board. On the PCB 115, a capacitor 129 and an IC 128 which is in the form of a ROM for storing data inherent to the head, such as the suitable driving conditions of the electrothermal energy conversion elements, ID number, ink color data, driving condition correcting data (head shading (HS) data) or PWM control conditions are disposed.

As shown in FIG. 17, the IC 128 and the capacitor 129 are disposed on the side of the PCB 115 which opposes the base plate 111 and at a position where they oppose a notch 111A of the base plate 111. Therefore, if the height of the IC when it is mounted on the PCB 115 is less than the thickness of the base plate 111, protrusion of the IC can be eliminated when the PCB 115 and the base plate 111 are adhered to each other, thus eliminating accommodation of a protruding IC during manufacture.

On the heater board 112 is disposed a ceiling plate 113 having a recess for forming a common liquid chamber where the ink supplied from the ink tank unit IT temporarily stays and a group of liquid passages for communicating the liquid chamber with the discharge ports. A discharge port forming member (orifice plate) 113A in which the ink discharge ports are formed is formed integrally with the ceiling plate 113. The ceiling plate 113 is closely attached to the heater board 112 by means of a pressing spring 114 to form the discharge portion 101.

A head unit cover 116 is a member formed of molding. In this head unit cover 116 are formed an ink supply tube portion 116A which enters the ink tank unit IT, an ink passage 116B for connecting the ink supply tube portion 116A to a ceiling plate side ink introducing tube portion, three pins 116C for positioning the head unit cover 116 relative to the base plate 111 or for fixing the head unit cover 116 to the base plate 111, a pin engaging portion 103, a mounting portion of the absorber 104 and other necessary portions. A passage lid 107 is disposed relative to the ink passage 116B. A filter 118 for removing air bubbles or dust and an O-ring for preventing leakage of ink from the connecting portion are disposed at the forward end of the ink supply tube 116A.

To assemble the head unit, the PCB 115 is positioned relative to the base plate 111 with a pin 111P projecting from the base plate 111 being inserted into a through-hole 115P formed in the PCB 115. The PCB 115 is adhered to the base plate 111 in that state. High accuracy is not required for fixing the PCB 115 to the base plate 111, because the heater board 112 which is to be mounted highly accurately relative to the base plate 111 is fixed to the base plate 111 separately.

Next, the heater board 112 is fixed to the base plate 111 accurately, and necessary electrical connection is made between the heater board 112 and the PCB 115. Thereafter, the ceiling plate 113 and the spring 114 are disposed, and adhesion and sealing are performed when necessary. Subsequently, the cover 116 is positioned with the three pins 116C provided on the cover 116 being inserted into holes 111C in the base plate 111. Three pins 116C are melted, by which assembly of the head unit is completed.

Ink Tank Unit

The ink tank unit shown in FIG. 17 has an ink container 211 which is a body of the ink tank unit, an ink absorber 215 which is impregnated with ink, an ink tank lid 216, electrode pins 212 for detecting the remaining amount of ink, and contact members 213 and 214 for the pins 212.

The ink container 211 has a portion 220 on which the pins 212, the contact members 213 and 214 and the aforementioned head unit IJU are mounted, a supply port 231 for receiving the ink supply tube portion 116A, the knob 201, and a hollow cylindrical portion 233 provided substantially at the center of the bottom surface of the ink container 211 as viewed in FIG. 17. Such an ink container 211 is formed of a resin as one unit.

The bottom surface of the cylindrical portion 233 is open with the ink charging process taken into consideration. After ink has been charged, a cap 217 is mounted on the bottom of the cylindrical portion 233 to close the cylindrical portion 233. In the upper end surface of the cylindrical portion 233 as viewed in FIG. 17, a spiral or zigzag groove 235 (a spiral groove is illustrated in FIG. 17) is formed. At one end 235A (at the center of the spiral groove shown in FIG. 17) of the groove 235, a hole which communicates with the inner space of the cylindrical portion 233 is formed. The other end 235B of the groove 235 opposes the air introducing port 203 formed in the tank lid 216.

In the side surface of the cylindrical portion 233, a plurality of grooves 237 (four grooves are illustrated in FIG. 17) are equiangularly formed in such a manner that they communicate with the inner space of the cylindrical portion 233. Consequently, communication between the interior of the ink tank unit and the atmosphere is achieved via the atmosphere introducing port 203, the spiral groove 235, the inner space of the cylindrical portion 233 and the groove 237. At that time, the inner space of the cylindrical portion 233 functions as a buffer for preventing ink leakage due to vibrations or oscillation. Also, provision of the spiral groove 233 which increases the route to the air introducing port 203 enables ink leakage to be more effectively prevented.

Furthermore, provision of the plurality of grooves 237 equiangularly on the side surface of the cylindrical portion 233 located substantially at the center of the ink tank enables air to be uniformly supplied to the absorber 215 located around the cylindrical portion 233, preventing local concentration of the ink in the absorber. This in turn ensures smooth supply of ink to the absorber compressed area (near the supply port 231) which will be described later.

The grooves 237 extend to below the center of the thickness W1 of the container, and are provided over a range which surrounds a range A where the support port 231 is present. Also, the grooves 237 are formed with the position of the remaining ink detecting pins 212 taken into consideration. Consequently, ink or air can be distributed uniformly around the pins, and retaining ink detection accuracy can thus be enhanced.

The absorber 215 impregnated with ink has a hole 215A which receives the cylindrical portion 233. When the cylindrical portion 233 is located in the hole 215A, the absorber 215 is not compressed by the cylindrical portion 233, and remaining of ink hence does not occur in the compressed area of the absorber 215 which has high negative pressure. The shape of the absorber 215 is not exactly the same as that of the space (indicated by a dot-dashed line in FIG. 17) which is formed by the ink tank lid 216 and the ink container 211 but the absorber bulges at the portion which is located near the support port 231. In this way, the bulging portion is compressed and thus has a high negative pressure when the absorber 215 is accommodated in the ink tank unit, allowing ink to be introduced toward the supply port 231 smoothly.

FIG. 18 is a schematic perspective view of an ink jet recording apparatus which employs the aforementioned recording head cartridge. This recording apparatus is a full-color serial type printer provided with the aforementioned replaceable recording head cartridges of four colors including black (Bk), cyan (C), magenta (M) and yellow (Y). The head used in this printer has a resolution of 400 dpi and 128 discharge ports. The drive frequency is 4 KHz.

In FIG. 18, IJC denote recording head cartridges of four colors including Y, M, C and Bk. In each of the recording head cartridges, a recording head and an ink tank where ink to be supplied to the recording head is reserved are formed as one unit. Each of the recording head cartridges IJC is detachably mounted on the carriage by means of the structure (not shown). A carriage 82 slidably engages with a guide shaft 211, and is connected to part of a drive belt 852 moved by a main scanning motor (not shown), by which the recording head cartridge IJC is made movable along the guide shaft 811 for scanning. Conveying rollers 815, 816 and 817 and 818 are provided substantially parallel to the guide shaft 811 in the recording area of the recording head cartridge IJC at this side and at the other side thereof as viewed in FIG. 18, respectively. The conveying rollers 815, 816, 817 and 818 are driven by a sub-scanning motor (not shown) to convey a recording medium P. The conveyed recording medium P opposes the surface of the recording head cartridge IJC where the discharge ports are provided and constitutes the recording surface.

A recovery system unit is provided in the area adjacent to the recording area of the recording head cartridge IJC into which the cartridge IJC can be moved. In the recovery system unit, a plurality of cap units 8300 are provided for corresponding plurality of cartridges IJC each having the recording head. The cap units 8300 are slidable to the right and left as viewed in FIG. 18 and are movable up and down. When the carriage 82 is at its home position, the cap units are brought into contact with the corresponding recording heads to cap them. A blade 8401 serves as the wiping member.

A pump unit 8500 sucks ink from the discharge ports of the recording heads and from the vicinity thereof through the cap units 8300.

(Fourth Embodiment)

In this embodiment, relatively small air bubbles which do not provide ink discharge are generated by driving the electrothermal energy conversion element in the liquid passage. The air bubbles generated in the liquid passage move into the liquid chamber and gather at a predetermined portion thereof to form a single air bubble. Such an air bubble functions as a buffer, that is, the energy (pressure waves) directed toward the liquid chamber during discharge is absorbed by expansion and contraction of this air bubble, and flow of ink in the direction opposite to the discharge port can thus be restricted. In other words, refilling after discharge can be made quickly. Consequently, when ink is continuously discharged from a certain discharge port, refilling to be conducted after the first discharge of this continuous discharge can be conducted excellently, and an adequate dot can be formed by the second discharge.

(Fifth Embodiment)

In the fifth embodiment, a relatively large air bubble that can function as buffers is generated utilizing the fine air bubbles present in the liquid passage.

That is, the fine air bubbles present in the liquid passage act as vapor generating nuclei and accelerate generation of the air bubble that can function as a buffer. Hence, in this embodiment, fine air bubbles that can serve as air bubble generating nuclei are generated before the ink contact surface is directly heated using the discharge heater 91. In this embodiment, a recording head having a resolution of 360 dpi and 64 discharge ports is used. The energy applied during recording per a single heater is 3.5 W (150 mA×23 V×7 μsec), and the discharge frequency is 3 kHz.

Figure 19:
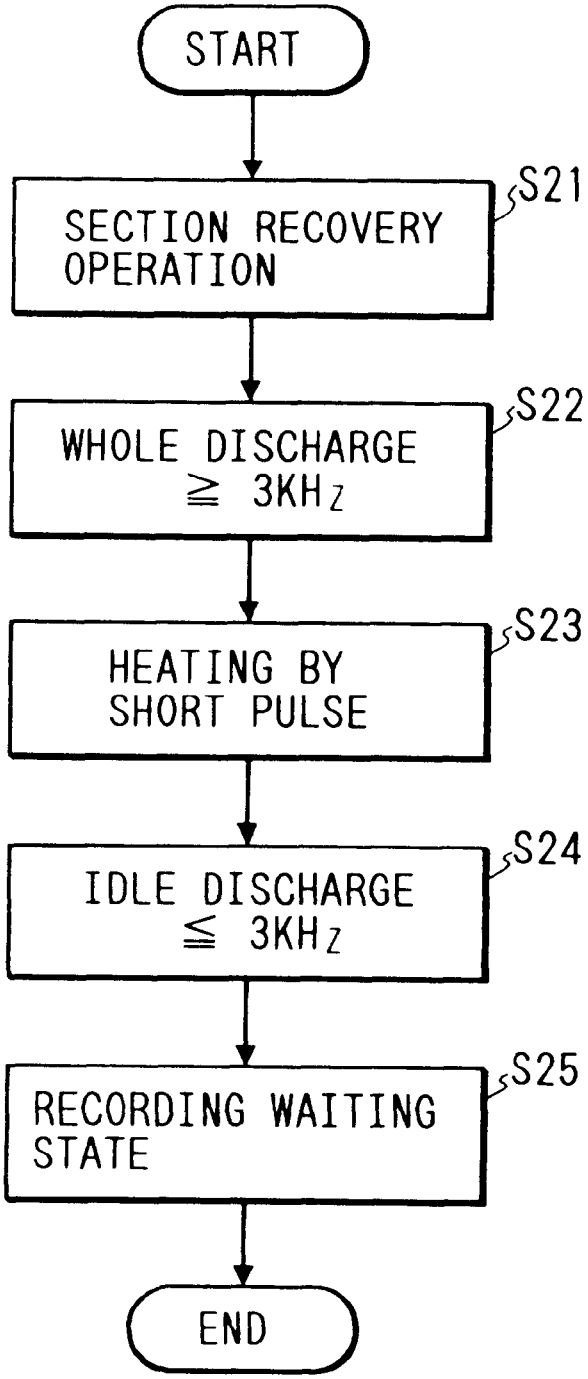
FIG. 19 is a flowchart showing the operation to be executed after the recovery process in the present invention.

FIG. 19 is a flowchart showing the sequence of generating an air bubble that can act as a buffer.

After the suction recovery operation has been conducted in step S21, all the discharge heaters are driven by a relatively high drive frequency (which is higher than the drive frequency) to continuously discharge ink in step S22. Consequently, growth (generation) and contraction (extinction) of air bubbles are repeated due to film boiling on the discharge heater, and ink droplets are discharged. At that time, part of the fine air bubbles (residual air bubbles) remain in each of the liquid passages or in the portion of the common liquid chamber near the liquid passage. The size and amount of residual fine air bubbles can be controlled by changing the drive frequency for continuous discharge and the discharge time, i.e., by changing the energy applied to the heater. This whole discharge is conducted at a predetermined portion of the recovery system, e.g., at the home position.

Immediately after the fine air bubbles have been generated, the ink in the liquid passage is heated to its boiling point in such a manner that it is not discharged using the discharge heater 91.

If ink is discharged at that time, it brings out heat energy. This causes the ink which has not been heated to be supplied from the common liquid chamber. Where air bubbles are generated by heating ink and thereby causing ink to boil, the higher the density of energy applied to the heater, the lesser the adverse effect.

That is, predetermined air bubbles may also be generated by heating the ink at a low energy level for a long period of time. However, heating of the ink for a long time increases the temperature of not only the heater board 100 which is in direct contact with the ink but also of the support member 300 made of metal and of other components of the recording head which have a large heat capacity, thus increasing the amount of energy required to generate air bubbles. Furthermore, temperature drop of the components having a large heat capacity is far slower than that of the components having a small heat capacity, such as the heater board 100. In the ink jet recording head, since the discharge rate of the ink changes in proportion to the temperature of the ink, an increase in the temperature of the components having a large heat capacity prolongs the time when this change in the discharge rate occurs. In other words, an increase in the temperature of the components having a large heat capacity precludes formation of dots having a uniform diameter and thus degrades the image quality.

In this embodiment, pulses having a pulse duration less than half that of the pulses applied during recording (which is less than half 7 μsec) are applied. Reduction in the level of energy applied caused by halving the pulse duration is compensated for by increasing the drive frequency. In this way, the temperature of the ink in the ink passage can be increased for a short period of time without ink being discharged. Consequently, vapor and air dissolved in the ink gather around the fine air bubbles and grow into the air bubble that can act as the buffer. Such air bubbles are pushed out of the liquid passage by subsequent air bubbles and part thereof flows into the common liquid chamber. Therefore, the amount of air bubbles which are reserved in the common liquid chamber can be controlled by controlling the level of energy applied to the discharge heater 91.

As mentioned above, since the air bubble generating nuclei (fine air bubbles) are present and since the vicinity of the heater has been heated when the air bubble generating process begins, the air bubbles that can act as the buffers can be more effectively generated.

After the air bubbles have been generated in step S23, the air bubbles which remain in the liquid passage are discharged by idle discharge in step S24. FIG. 9A shows an example of how air bubbles remain in the liquid passage. FIG. 9B shows another example of how air bubbles remain in the liquid passage. In the state shown in FIG. 9B, ink is refilled due to capillary phenomenon. That is, idle discharge is conducted in a state wherein the air bubbles are present in the liquid passage to discharge the ink located at the forward portion of the liquid passage and thereby obtain a state in which ink can be refilled in the liquid passage due to capillary force. Consequently, ink is refilled in the liquid passage and the recording head is made ready for use for recording. However, there is a possibility that fine air bubbles are present in the ink in the liquid passage. Hence, idle discharge is executed a plurality of times at a drive frequency lower than the normal drive frequency (which is equal to or lower than the discharge drive frequency) to discharge such fine air bubbles.

Another effective method of discharging the air bubbles in the liquid passage is to conduct idle discharge alternately on the even-numbered discharge ports and on the odd-numbered discharge ports. In this method, the air bubbles which stay between the adjacent discharge ports in the liquid passage are discharged. This method has been proposed in, for example, European Patent Publication No. 0,451,827.

After idle discharge, recording is awaited in step S25.

As mentioned above, by heating the ink after the ink discharge process has been executed, adequate air bubbles which do not adversely affect discharge can be reserved in the common liquid chamber. Consequently, air bubble generating energy (pressure waves) applied to the common liquid chamber during discharge can be absorbed by expansion and contraction of these air bubbles, and the effect of ink pulsation caused by discharge and directed toward the ink tank can be restricted. As a result, delay of refilling which occurs after the first discharge in the continuous discharge can be restricted without using a special liquid chamber buffer.

(Sixth Embodiment)

An example of the suction recovery process of the recording head in which the air bubbles that can act as the buffers have been reserved in the common liquid chamber by, for example, the method described in the fifth embodiment will be described below.

Normal suction recovery operation is aimed at removal of viscous ink present in the vicinity of the discharge port in the recording head, in the liquid chamber or in the common liquid chamber which is required for normal discharge. In such a suction recovery operation, the air bubbles not only in the liquid passage but also in the common liquid chamber that can act as the buffers may also be removed, eliminating the effect of air bubble generation.

Hence, in this embodiment, only the air bubbles of the viscous ink which remain in the liquid passage are removed. That is, suction is conducted at a lower suction level than in the normal suction recovery operation.

Practically, suction is conducted at a suction pressure which is lower by 20 to 30% than in the normal suction recovery operation for the same period of time as that of the normal suction recovery operation. Suction at such a low pressure enables the air bubbles only in the liquid passage to be removed. Suction at such a low pressure enables the effect on the air bubbles in the common liquid chamber that can act as the buffers to be minimized.

Such a weak suction reduces the amount of ink which is discharged together with the air bubbles in the suction recovery operation, thus reducing the amount of ink which is wasted and thereby prolonging the life of the ink cartridge.

A reduction in the amount of ink which is discharged enables the size of the container where wasted ink is reserved to be reduced, thus reducing production cost.

(First Modification of Sixth Embodiment)

Modification of the sixth embodiment will be described below. In this modification, the same weak suction as that conducted in the sixth embodiment is conducted, but a different suction method is used.

That is, whereas in the sixth embodiment, suction is conducted at a lower suction pressure than in the normal suction operation, in this modification, the suction level is reduced by shortening the suction time.

In this modification, suction is conducted at the same suction pressure as that for the normal suction but for a shorter suction time. Such a suction can be achieved either by controlling the drive conditions of the suction pump and thereby shortening the suction time or by mechanically releasing capping while electrically maintaining normal suction conditions. Suction time is set to an optimum value which ensures that the air bubbles in the liquid passage are removed but that the air bubbles in the common liquid chamber are not removed.

The weak suction conducted in this modification assures the same suction level as that in the sixth embodiment and hence the same effect. Furthermore, since the suction time is shortened, the time required to executed the sequence can be reduced.

(Second Modification of Sixth Embodiment)

Air bubbles in the liquid passage can be removed while the predetermined air bubbles are reserved in the common liquid chamber by conducting variable control of weak suction.

That is, the time during which suction has not been conducted is managed using a timer, and the suction level of weak suction is varied in accordance with that time. As the number of times recording is conducted increases, the amount of air bubbles reserved in the common liquid chambers increases. Such air bubbles may not be removed by conducting the suction operation once. If formation of the air bubbles that can act as the buffers is conducted in that state, excessive air bubbles may enter the common liquid chamber. In that case, the aforementioned weak suction operation which is conducted once may not be sufficient to completely remove the air bubbles in the liquid passage while remaining the air bubbles that can act as the buffers.

To prevent this problem, the number of times weak suction is conducted is changed in accordance with the time during which suction has not been conducted. Consequently, the amount of air bubbles which are reserved in the common liquid chamber while suction is not conducted is controlled to a level which ensures that the air bubbles in the liquid passage can be removed by weak suction. The pressure or time of weak suction may also be controlled in accordance with the time during which suction is not conducted.

(Seventh Embodiment)

In this embodiment, air bubbles which are to be reserved in the common liquid chamber are generated by heating the ink in a so-called dummy nozzle by means of a heater provided in that nozzle.

This heater provided in the dummy nozzle may be the similar one to the discharge heater or may be the one specially prepared to effectively generate air bubbles. In this embodiment, the same heater as the discharge heater is used. Also, in addition to 64 ink discharging ports, the recording head used in this embodiment has three discharge ports at each of the two sides thereof as the dummy nozzles.

Figure 20:
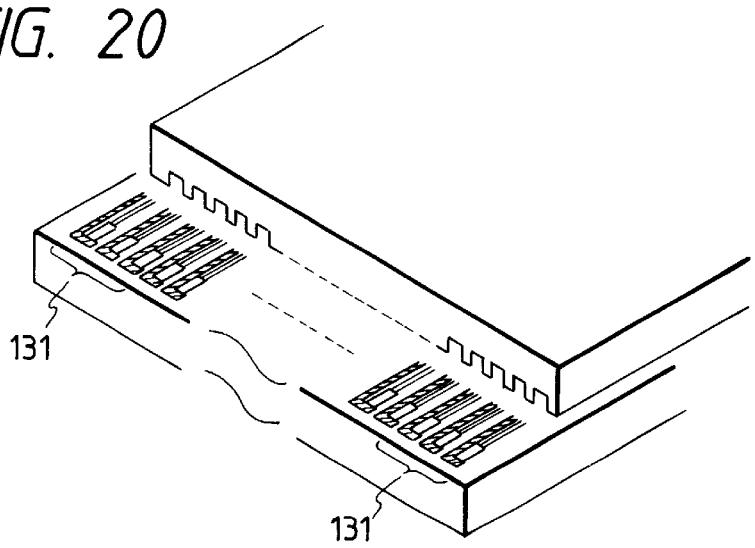
FIG. 20 illustrates an example of an air bubble introducing means according to the present invention.

FIG. 20 is a schematic exploded perspective view of such a recording head.

Heaters 131 provided in the dummy nozzles have the same configuration as that of the other heaters. When the heater 131 is driven and heated, the ink heated to its boiling point generates air bubbles in the liquid passage of the dummy nozzle. The air bubbles generated in the liquid passage are pushed out of the liquid passage by subsequent air bubbles, and part thereof flows into the common liquid chamber. In the common liquid chamber, such air bubbles form an air bubble that can act as the buffer.

Where the air bubbles that can act as the buffers are generated using the discharge heater, the air bubbles remaining in the liquid passage must be removed by idle discharge for a subsequent discharge. However, in this embodiment, since the air bubbles that can act as the buffers are generated only in the dummy nozzles, the discharge ports used for normal recording maintain the state shown in FIG. 9B, i.e., the discharge ports are ready for recording. Hence, idle discharge to be performed after formation of air buffers can be eliminated.

(First Modification of Seventh Embodiment)

Figure 21:
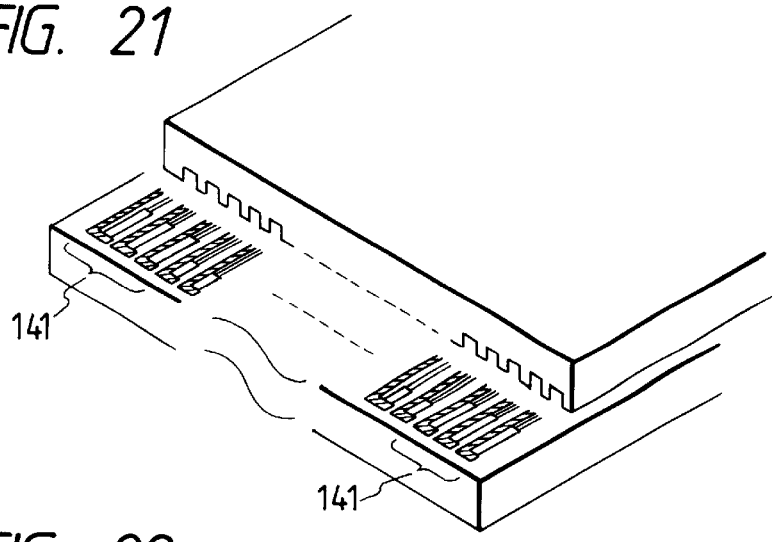
FIG. 21 illustrates another example of an air bubble introducing means according to the present invention.
Figure 22:
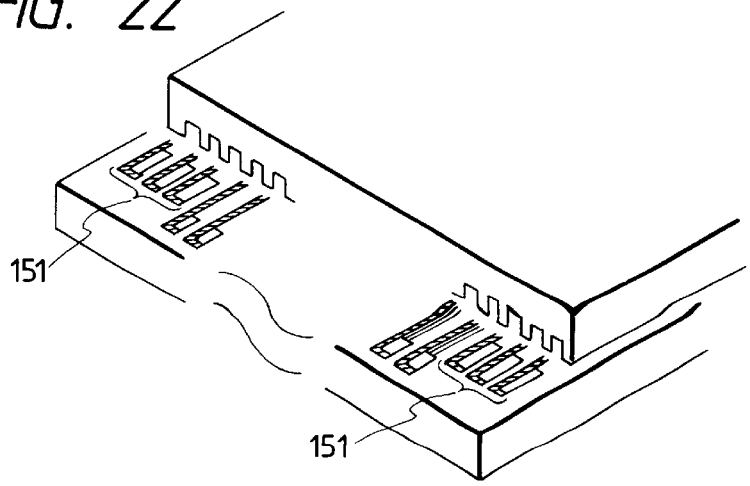
FIG. 22 illustrates still another example of an air bubble introducing means according to the present invention.

In this modification, a heater 141 for the dummy nozzle is made longer than the heater used for normal recording, i.e., the air bubble generating surface of the heater is expanded from that of the heater used for normal recording, as shown in FIG. 21. In this way, effective air bubble generation is obtained, and formation of air bubblers can be completed in a shorter period of time.

(Second Modification of Seventh Embodiment)

In this modification, a relatively long heater 151 for the dummy nozzle, shown in the first modification of the seventh embodiment, is disposed at a position remote from the discharge surface where the other heaters used for recording are provided, i.e., closer to the common liquid chamber. In this way, the air bubbles generated in the liquid chamber can be effectively moved into the common liquid chamber, and formation of air buffers can be completed in a shorter period of time.

In the seventh embodiment and its modifications, air bubbles are generated at the two end portions of the discharge port array. Therefore, movement of the air bubbles in the common liquid chamber is one way movement from the peripheral portion thereof to the central portion thereof. Consequently, air bubbles are uniformly distributed in the common liquid chamber, and can thus be functioned as the buffers uniformly and effectively relative to the individual liquid passages.

The structure described in connection with FIG. 15 can be utilized also in the fourth to seventh embodiments.

That is, an example of the structure for driving the discharge heaters (including the heaters for the dummy nozzles) or the sub-heaters will be described below with reference to FIG. 15. FIG. 15 illustrates only three discharge ports and corresponding discharge heaters 91 or only two heaters 131 (141, 151) for the dummy nozzles provided on the two sides of the discharge heater 91. Hereinafter, description of the discharge heaters 91 substitutes for description of the heaters 131 (141, 151) for the dummy nozzles.

In the liquid passage 14 and the common liquid chamber 15, the discharge heaters 91 and the sub-heaters 910 for controlling the ink temperature are respectively provided. Also, drivers 91D and 910D for respectively driving the discharge heaters 91 and the sub-heaters 910 are provided. The discharge heaters 91 are driven by the AND signal obtained from both the pulse width signal generated by a pulse width generating circuit 91C on the basis of the pulse width data from the MPU 1550 and the discharge signal generated by a decoder circuit 91B on the basis of the recording data (discharge data) from the MPU 1550. In this way, the pulse duration and the drive frequency can be changed between during ink discharge and during air bubble generation, as mentioned above. The sub-heaters 910 are driven by a drive signal generated by a decoder circuit 910A on the basis of the drive data from the MPU 1550. The MPU 1550 transfers the recording data, the pulse width data and the drive data on the basis of the processing programs stored in the ROM 1550A. At that time, the RAM 1550B serves as the work area for executing the programs.

As mentioned above, in the fifth to seventh embodiments, relatively large air bubbles are generated using the fine air bubbles generated in the liquid passage as the nuclei, and formation of the air buffers in the liquid chamber can thus be effectively conducted. The air buffers absorb the discharge energy (pressure waves) directed toward the liquid chamber during discharge, and thus restrict flow of the ink in the direction opposite to the discharge port. That is, refilling can be quickly conducted after discharge.

After the air buffers have been formed in the liquid chamber, suction is conducted for suction recovery or the like at a lower level than in the normal recovery operation so as to prevent the air buffers from being discharged by the discharge recovery process.

Furthermore, the air buffers can be formed in the liquid passage of each of the so-called dummy nozzles provided at the two end portions of the discharge port array used for recording.

Consequently, when ink discharge is conducted continuously from a certain discharge port, refilling to be conducted after the first discharge of this continuous discharge can be conducted excellently, and an adequate dot can be formed by the second discharge.

The present invention can also be applied to a full-line type recording head having a length corresponding to the length of the recording medium having the maximum size that can be recorded by the recording apparatus. Such a recording head may be formed by combining a plurality of recording heads. Alternatively, it may have a single recording head structure.

The serial type printers to which the present invention can be applied include a recording head fixed to the apparatus body, a chip type replaceable recording head in which electrical connection to the apparatus body and ink supply can be achieved by being mounted on the apparatus body, and a cartridge type recording head in which the ink tank and the recording head are formed as one unit.

Furthermore, provision of the recovery means for recovering the recording head or preliminary auxiliary means as the component of the recording apparatus is desired from the viewpoint of further enhancing the advantages of the present invention. Practically, such a component may be the capping means, cleaning means, pressurizing or suction means of the recording head, the electrothermal energy conversion element, another heating element, the preliminary heating means formed by combining the electrothermal energy conversion element and another heating element or the preliminary discharge means.

There is no limitation to the type or number of recording heads which are mounted on the recording apparatus: a single recording head of a single color may be provided, or a plurality of recording heads corresponding to a plurality of colors or densities may be provided. That is, the present invention can be applied not only to a recording apparatus which is capable of recording in a single main color, such as in black, but also to a recording apparatus capable of recording in a plurality of colors or in full colors. Where a plurality of recording heads are provided, the recording head may be formed by combining the plurality of recording heads or may have a single recording head structure.

In the aforementioned embodiments of the present invention, liquid ink has been described. However, an ink which solidifies at temperatures lower than the room temperatures and which softens or liquifies at the room temperatures can also be used. In the ink jet recording, since the temperature of the ink is generally adjusted in a range between 30° C. and 70° C. so that the ink has a viscosity which ensures stable discharge, any ink which is liquid when a recording signal is applied thereto can be used. Also, an ink of the type which liquifies when thermal energy is applied thereto in accordance with the recording signal and which is thus discharged in the form of liquid or which begins solidifying by the time it reaches the recording medium can be used in the present invention. Such an ink is capable of preventing an increase in the temperature because it utilizes thermal energy as energy required to change the phase from solid to liquid. Also, such an ink is capable of preventing evaporation.

Furthermore, the ink jet recording apparatus to which the present invention can be applied may be used as an image output terminal of data processing apparatus, such as a computer, a copying machine when combined with a reader or a facsimile machine having a transmission/reception function.

As will be understood from the foregoing description, it is possible according the present invention to form adequate air bubbles which do not adversely affect discharge by means of the air bubble formation means, such as a sub-heater for heating the ink in the ink reservoir portion, such as a common liquid chamber. The formed air bubbles function as the buffers and thereby absorb the discharge energy (pressure waves) directed toward the common liquid chamber during discharge to restrict flow of the ink in the direction opposite to the discharge port. That is, refilling after discharge can be quickly performed.

Consequently, when ink is continuously discharged from a certain discharge port, refilling to be conducted after the first discharge of this continuous discharge can be conducted excellently, and an adequate dot can be formed by the second discharge.

What is claimed is:

1. A liquid jetting device comprising:

a plurality of liquid passages each having a liquid ejecting element and communicating with an ejection orifice for discharging a liquid during a jetting operation;

a common liquid chamber communicating directly with each of said plurality of liquid passages; and air bubble generating means, disposed in said common liquid chamber, for establishing an air-bubble to be sustained in said common liquid chamber, the air bubble being established by boiling in the common liquid chamber caused by applying thermal energy to the liquid, the air-bubble being sustained after establishment thereof without a further application of thermal energy, wherein the jetting operation is performed while the air bubble is sustained in said common liquid chamber.

2. A liquid jetting device according to claim 1, wherein the thermal energy applied to the liquid to establish the air sustained bubble is insufficient to cause liquid discharge from said ejection orifice.

3. A liquid jetting device according to claim 1, wherein the air bubble is established from gas dissolved in the liquid in said device.

4. A liquid jetting device according to claim 3, wherein the air bubble is established by heating the liquid in said device at a temperature not exceeding a nucleate boiling point of the liquid.

5. A liquid jetting device according to claim 1, wherein the sustained bubble is generated by nucleate boiling.

6. A recording head for ejecting ink, said recording head comprising:

an ejection orifice for ejecting the ink therethrough during a recording operation;

ejection energy application means, having ink therein and communicating with said ejection orifice, for applying ejection energy to eject the ink through said ejection orifice to perform the recording operation;

an ink reservoir section communicating directly with said ejection energy application means for containing ink to be supplied to said ejection energy application means; and air bubble formation means, provided in said ink reservoir section, for establishing in said ink reservoir section a sustained air bubble by boiling caused in said ink reservoir section by heating ink in said recording head, the air bubble being sustained after establishment thereof without further heating, whereby the recording operation is performed while the air bubble is sustained in said ink reservoir section.

7. A recording head according to claim 6, wherein said air bubble formation means includes heating means for heating said recording head to generate air bubbles in the ink in said recording head, and said recording head is shaped so that the air bubbles generated by said heating means collect in said ink reservoir section.

8. A recording head according to claim 6, wherein said air bubble formation means establishes the air bubble in said ink reservoir using section using an electrothermal conversion member.

9. A recording head according to claim 6, wherein said air bubble formation means comprises a sub-heater for heating the ink to be supplied to said ejection energy application means contained in said ink reservoir section.

10. A recording head according to claim 6, wherein the air bubble is formed from a gas dissolved in ink in said recording head.

11. A recording head according to claim 10, wherein the air bubble is formed by heating the ink in said recording head at a temperature not exceeding a nucleate boiling point of the ink.

12. A recording head according to claim 6, wherein the sustained bubble is generated by nucleate boiling.

13. An ink-jet recording apparatus comprising:

a recording head having an ejection orifice for ejecting ink therethrough during a recording operation, ejection energy application means communicating with said ejection orifice for applying ejection energy to eject the ink through said ejection orifice to perform the recording operation, an ink reservoir section communicating directly with said ejection energy application means for containing ink to be supplied to said ejection energy application means, and heating means provided in said ink reservoir section for heating ink; and air bubble formation control means for operating said heating means for generating an air bubble by causing boiling in said ink reservoir section by applying heat to the ink, the air bubble being sustained after generation thereof without a further operation of said heating means, wherein the recording operation is performed while the air bubble is sustained in said ink reservoir section.

14. An ink-jet recording apparatus according to claim 13, wherein said recording head is shaped so that air bubbles generated by said heating means collect in said ink reservoir section.

15. An ink-jet recording apparatus according to claim 13, wherein air bubbles are generated by said heating means after the ink in said ejection energy application means and the ink in said ink reservoir has been discharged.

16. An ink-jet recording apparatus according to claim 15, wherein an electrothermal conversion member for generating thermal energy is disposed in said ejection energy application means to cause ejection of the ink in said ejection energy application means through said ejection orifice by generating a bubble by film boiling in the ink in said ejection energy application means.

17. An ink-jet recording apparatus according to claim 13, wherein an electrothermal conversion member for generating thermal energy is disposed in said ejection energy application means to cause ejection of the ink through said ejection orifice by generating a bubble caused by film boiling in the ink in said ejection energy application means.

18. An ink-jet recording apparatus according to claim 17, wherein said air bubble formation means establishes the air bubble in said ink reservoir section by applying a plurality of electrical signals having a duration shorter than an electrical signal applied to said electrothermal conversion member to eject the ink through said ejection orifice.

19. An ink-jet recording apparatus according to claim 17, wherein said air bubble formation means establishes the air bubble in said ink reservoir section using an electrothermal conversion member.

20. An ink-jet recording apparatus according to claim 13, wherein said recording head is a serial head.

21. An ink-jet recording apparatus according to claim 13, wherein said recording head is a full-multi head.

22. An ink-jet recording apparatus according to claim 13, wherein said recording head further comprises means for discharging a plurality of ink colors.

23. An ink-jet recording apparatus according to claim 13, wherein the air bubble is established from gas dissolved in ink in said recording head.

24. An ink-jet recording apparatus according to claim 23, wherein the air bubble is established by heating the ink in said recording head at a temperature not exceeding a nucleate boiling point of the ink.

25. An ink-jet recording apparatus according to claim 13, wherein the sustained bubble is generated by nucleate boiling.

26. An ink-jet recording apparatus comprising:

a recording head having an ejection orifice for ejecting ink therethrough during a recording operation, a liquid passage communicating with said ejection orifice and having therein thermal energy generating means for generating thermal energy to form a bubble by film boiling in said liquid passage for ejecting the ink through said ejection orifice to perform the recording operation, and a liquid chamber communicating directly with said liquid passage for containing ink to be supplied to said liquid passage;

heating means provided in said liquid chamber for heating ink in said liquid chamber;

driving means for generating thermal energy in said thermal energy generation means;

control means for controlling said heating means during a non-recording operation to generate in said liquid chamber an air bubble by boiling caused in said liquid chamber, the air bubble being generated in said liquid chamber without causing ink ejection; and ejection recovery means for ejecting the ink through said ejection orifice in a non-recording operation, to maintain satisfactory ink ejection through said ejection orifice, at a reduced rate or by using less power after the air bubble is generated.

27. An ink-jet recording apparatus according to claim 26, wherein the air bubble is formed from gas dissolved in ink in said recording head.

28. An ink-jet recording apparatus according to claim 26, wherein the sustained bubble is generated by nucleate boiling.

* * * * *

UNITED STATES PATENT AND TRADEMARK OFFICE

CERTIFICATE OF CORRECTION

PATENT NO. : 6,260,962 B1
DATED : July 17, 2001
INVENTOR(S) : Kentaro Yano et al.

It is certified that error appears in the above-identified patent and that said Letters Patent is hereby corrected as shown below:

Column 6,
Line 36, “fort he” should read -- for the --.

Column 18,
Line 43, “recover” should read -- recovery --.

Column 19,
Line 61, “100 μm” should read -- 100 μm. --.

Column 28,
Line 4, “between during” should read -- during --.

Column 30,
Line 35, “using” (first occurrence) should be deleted.

Column 31,
Line 37, “full-multi head” should read -- full multi-head --.

Signed and Sealed this

Eleventh Day of June, 2002

*Attest:*

*Attesting Officer*

JAMES E. ROGAN
*Director of the United States Patent and Trademark Office*